US007613421B2

(12) United States Patent
Kanematsu et al.

(10) Patent No.: US 7,613,421 B2
(45) Date of Patent: Nov. 3, 2009

(54) FIXING DEVICE AND IMAGE FORMING APPARATUS

(75) Inventors: Yoshiharu Kanematsu, Osaka (JP); Kuniaki Nakano, Osaka (JP); Shinichi Uchida, Osaka (JP)

(73) Assignee: Kyocera Mita Corporation (JP)

( * ) Notice: Subject to any disclaimer, the term of this patent is extended or adjusted under 35 U.S.C. 154(b) by 432 days.

(21) Appl. No.: 11/512,935

(22) Filed: Aug. 30, 2006

(65) Prior Publication Data

US 2007/0048036 A1 Mar. 1, 2007

(30) Foreign Application Priority Data

| | | |
|---|---|---|
| Aug. 31, 2005 | (JP) | 2005-251770 |
| Nov. 22, 2005 | (JP) | 2005-337403 |
| Nov. 29, 2005 | (JP) | 2005-343243 |
| May 22, 2006 | (JP) | 2006-141416 |

(51) Int. Cl.
*G03G 15/20* (2006.01)

(52) U.S. Cl. ..... 399/323

(58) Field of Classification Search ..... 399/322, 399/323, 399; 347/156
See application file for complete search history.

(56) References Cited

U.S. PATENT DOCUMENTS

| | | | | |
|---|---|---|---|---|
| 4,252,310 | A * | 2/1981 | Kono et al. | 399/399 X |
| 5,517,292 | A * | 5/1996 | Yajima et al. | 399/323 |
| 7,429,995 | B2 | 9/2008 | Sato et al. | |
| 2002/0025204 | A1 | 2/2002 | Ando et al. | |

FOREIGN PATENT DOCUMENTS

| | | |
|---|---|---|
| CN | 1770033 | 5/2006 |
| JP | 2004-061854 | 2/2004 |
| JP | 2004-157481 | 6/2004 |

* cited by examiner

*Primary Examiner*—Sandra L Brase
(74) *Attorney, Agent, or Firm*—Gerald E. Hespos; Anthony J. Casella

(57) ABSTRACT

A fixing device includes a fixing roller for fixing a toner image transferred onto a sheet and conveying the sheet along a conveyance path, and a separating mechanism for separating the sheet from the fixing roller. The separating mechanism includes a claw member having a tip portion in contact with the outer circumferential surface of the fixing roller to separate the sheet from the fixing roller, a holder member for holding the claw member, and a rotary member rotatably held in the holder member downstream of the tip portion relative to the conveyance path and adapted to guide the sheet separated from the fixing roller to a downstream side along the conveyance path while being rotated. The holder member has a guiding portion for guiding the sheet to the rotary member on the conveyance path between the tip portion of the claw member and the rotary member.

17 Claims, 20 Drawing Sheets

FIXING DEVICE AND IMAGE FORMING APPARATUS

BACKGROUND OF THE INVENTION

1. Field of the Invention

The present invention relates to a fixing device for fixing a toner image transferred onto a sheet and an image forming apparatus employing such a fixing device.

2. Description of the Related Art

There have been conventionally known image forming apparatuses constructed such that an electrostatic latent image on the outer circumferential surface of a photoconductive drum is developed with toner to form a toner image, and an output image is obtained by transferring this toner image to a sheet. There have been also known fixing devices installed in such image forming apparatuses to fix a toner image transferred onto a sheet.

A conventional fixing device is provided with a fixing (heat) roller for heating a sheet and a pressure (press) roller for pressing the sheet against the fixing roller while defining a nip area in cooperation with the fixing roller. In the fixing device constructed in this way, the sheet may, in some cases, wind around the fixing roller by being conveyed from the nip area between the two rollers while being adhered to the fixing roller. In order to prevent the winding of the sheet, the fixing device is generally provided with a separating claw for separating the sheet from the fixing roller. This separating claw is arranged in the vicinity of a downstream end of the nip area and also has a function of guiding the sheet separated from the fixing roller to a downstream side of a conveyance path.

However, since the separating claw guides the sheet while separating it as described above, there are cases where an image formed on the sheet is scratched by the separating claw. This is because the separating claw constantly in contact with the fixing roller comes to have a high temperature and the sheet comes into contact with the separating claw having a high temperature for a specified period, thereby melting (re-melting) the toner on the sheet.

As means for solving this problem is known an art of guiding the sheet separated from the fixing roller by the separating claw onto a guiding member arranged at a relatively close position from a separating position (tip of the separating claw) and guiding the sheet to the downstream side of the conveyance path by means of the guiding member. Since this guiding member is provided separately from the separating claw and kept at a lower temperature than the separating claw, the melting of the toner on the sheet is suppressed upon being held in contact with the guiding member for a specified period.

However, in the above construction, the guiding member needs to be arranged in the vicinity of the downstream end of the nip area between the two rollers, the sheet may be, in some cases, conveyed from the nip area while being strongly pressed against the guiding member due to the elasticity thereof. This causes a problem of creating image abrasion (guiding trace) on the outer surface of the image on the sheet.

As a countermeasure against such an image abrasion, an art of guiding a sheet separated from a fixing roller to a downstream side of a conveyance path by means of a rotatable roller or the like has been proposed, for example, in Japanese Unexamined Patent Publication No. 2004-61854. This patent publication discloses a fixing device in which a rotary member is attached to a separating-claw protecting member that pivots together with a separating claw. This separating-claw protecting member turns together with the separating claw in a direction away from the fixing roller at the time of a sheet jam, thereby preventing the separating claw from being excessively pressed against the fixing roller to damage the separating claw and the fixing roller. Further, the sheet separated from the fixing roller by the separating claw is guided to the rotary member without coming into contact with the separating-claw protecting member, thereby preventing an occurrence of an image abrasion on the sheet after an image fixing operation.

However, this patent publication discloses no member for actively guiding the sheet separated by the separating claw toward the rotary member. Accordingly, in the case where a separating claw 70 and a roller member (rotary member) 80 are arranged, for example, to have such a positional relationship as to largely change a conveyance direction of a separated sheet P as shown in FIG. 24, it is difficult to smoothly bring the sheet P into contact with the outer circumferential surface of the roller member 80 and a large load acts on the sheet P. This causes an occurrence of a bridge phenomenon called "pull-back" of the sheet P resulting from the elasticity of the sheet P, thereby causing a problem of bringing a bridged part of the sheet P into contact with the separating claw 70. Since this causes the separating claw to scratch the sheet, there is a problem of reducing image quality.

SUMMARY OF THE INVENTION

In view of the problems residing in the prior art, an object of the present invention is to provide a fixing device which can suppress reduction in the image quality regardless of the device construction and sheet quality, and an image forming apparatus employing such a fixing device.

In order to accomplish the above object, one aspect of the present invention is directed to a fixing device, comprising a fixing roller for fixing a toner image transferred onto a sheet and conveying the sheet along a specified conveyance path, and a separating mechanism for separating the sheet from the fixing roller, the separating mechanism including a claw member having a tip portion in contact with the outer circumferential surface of the fixing roller to separate the sheet from the fixing roller, a holder member for holding the claw member, and a rotary member rotatably held in the holder member at a position downstream of the tip portion of the claw member with respect to the conveyance path and adapted to guide the sheet separated from the fixing roller to a downstream side along the conveyance path while being rotated, the holder member having a guiding portion for guiding the sheet to the rotary member on the conveyance path between the tip portion of the claw member and the rotary member.

These and other objects, features, aspects and advantages of the present invention will become more apparent upon a reading of the following detailed description and accompanying drawings.

BRIEF DESCRIPTION OF THE DRAWINGS

FIGS. 21A to 21C are plan views showing an exploded state of the separating mechanism according to the fourth embodiment, wherein FIG. 21A shows a part of a housing of a fixing device, FIG. 21B shows the separating claw unit and coil springs, and FIG. 21C shows the supporting member.

FIGS. 22A to 22C are front views showing the exploded state of the separating mechanism according to the fourth embodiment, wherein FIG. 22A shows the part of the housing of the fixing device, FIG. 22B shows the separating claw unit and the coil springs, and FIG. 22C shows the supporting member.

FIGS. 23A to 23C are side views showing the exploded state of the separating mechanism according to the fourth embodiment, wherein FIG. 23A shows the part of the housing of the fixing device, FIG. 23B shows the separating claw unit and the coil springs, and FIG. 23C shows the supporting member.

DETAILED DESCRIPTION OF THE PREFERRED EMBODIMENTS

Hereinafter, embodiments of the present invention are described with reference to the accompanying drawings.

First Embodiment

Figure 1:
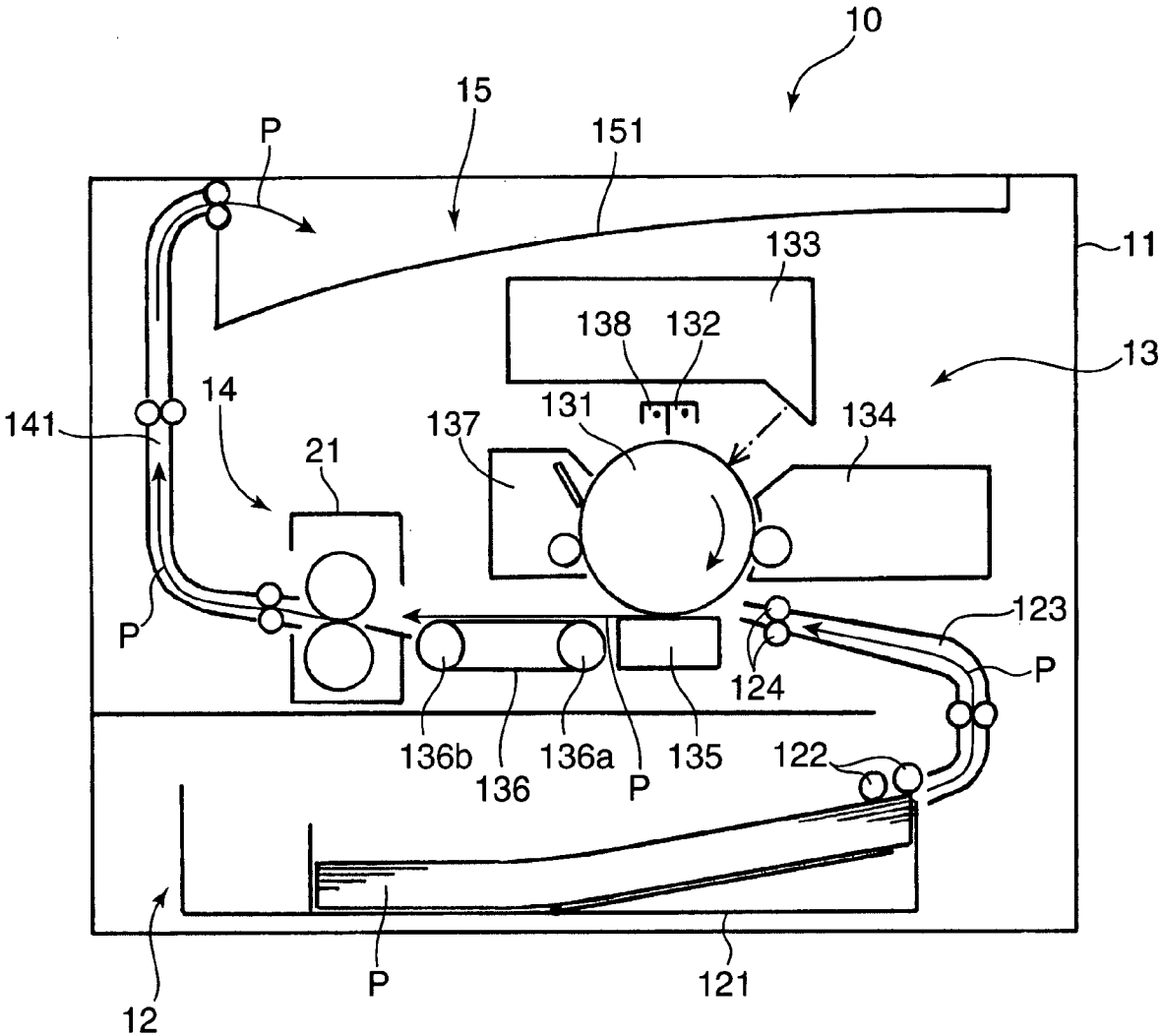
FIG. 1 is a front view in section showing the entire construction of a printer including an image fixing unit according to one embodiment of the invention.

FIG. 1 is a view showing the entire construction of a printer including an image fixing unit according to one embodiment of the invention, and FIGS. 2 to 6 are views showing the construction of the image fixing unit according to a first embodiment of the present invention. First with reference to FIG. 1, the entire construction of the printer 10 including the image fixing unit 14 according to the first embodiment of the present invention is described. It should be noted that the image fixing unit 14 is one example of a "fixing device" of the present invention.

As shown in FIG. 1, in the printer 10 of this embodiment, a sheet storing unit 12 for storing a stack of sheets (recording sheets) P to which printing is applied, an image forming unit 13 for transferring images to the sheets P dispensed one by one from a bunch of sheets stored in the sheet storing unit 12, and an image fixing unit 14 for fixing the image transferred to the sheet P in the image forming unit 13 to the sheet P are provided in an apparatus main body 11, and a discharging unit 15 onto which the sheet P having the image fixed thereto in the image fixing unit 14 is discharged is provided atop the apparatus main body 11.

The sheet storing unit 12 is detachably mountable into the apparatus main body 11, and includes a sheet cassette 121 capable of accommodating a plurality of sheets (recording sheets) P while stacking them one over another. Further, a pair of pickup rollers 122 for dispensing the sheets P one by one from the stack of sheets accommodated in the sheet cassette 121 are provided at an upper right end of the sheet cassette 121 in the drawing. The sheet P dispensed from the sheet cassette 121 by driving the pickup rollers 122 is fed to the image forming unit 13 via a sheet conveyance path 123 and a pair of registration rollers 124 disposed at a downstream end of the sheet conveyance path 123.

The image forming unit 13 has a function of transferring a toner image to a sheet P in accordance with image information electronically transmitted from an unillustrated computer or the like. The image forming unit 13 includes a photoconductive drum 131 rotatable about a central axis thereof extending in forward and backward directions (directions normal to the plane of FIG. 1), a charger 132, an exposing device 133, a developing device 134, a transfer device 135, a conveyance belt 136, a cleaning device 137 and a charge remover 138, the devices 132 to 138 being arranged clockwise in this order along the outer circumferential surface of the photoconductive drum 131 from a position right above the photoconductive drum 131.

An amorphous silicon layer is formed on the outer circumferential surface of the photoconductive drum 131, so that an electrostatic latent image and a toner image based on this electrostatic latent image can be easily formed on the outer circumferential surface.

The charger 132 has a function of uniformly charging the outer circumferential surface of the photoconductive drum 131 rotating clockwise. In the example shown in FIG. 1, electric charges are imparted to the outer circumferential surface of the photoconductive drum 131 by corona discharge. Instead of the charger 132 as a member for imparting electric charges to the outer circumferential surface of the photoconductive drum 131, a charging roller may be used which imparts electric charges by being driven to rotate while being held in contact with the outer circumferential surface of the photoconductive drum 131.

The exposing device 133 has a function of illuminating the outer circumferential surface of the rotating photoconductive drum 131 with a laser beam whose intensity is modulated based on an image data electronically transmitted from an external apparatus such as a computer, thereby removing the electric charges in the parts of the outer circumferential surface of the photoconductive drum 131 illuminated with the laser beam to form an electrostatic latent image on the outer circumferential surface of the photoconductive drum 131.

The developing device 134 has a function of attaching toner to the parts of the outer circumferential surface of the photoconductive drum 131 where the electrostatic latent image is formed by supplying the toner to the outer circumferential surface of the photoconductive drum 131, thereby forming a toner image on the outer circumferential surface of the photoconductive drum 131.

The transfer device 135 has a function of transferring the positively charged toner image formed on the outer circumferential surface of the photoconductive drum 131 to the sheet P fed to a position right below the photoconductive drum 131 by driving the registration rollers 124, and imparts negative electric charges having a polarity opposite to the electric charges of the toner image to the sheet P.

The conveyance belt 136 is for conveying the sheet P having the image transferred thereto by the transfer device 135 toward the image fixing unit 14, and is mounted between a drive roller 136*a* disposed near the transfer device 135 and a driven roller 136*b* disposed near the image fixing unit 14. This conveyance belt 136 is driven to turn in synchronism with the rotation of the photoconductive drum 131, whereby the sheet P is conveyed toward the image forming unit 14. Accordingly, by the transfer device 135 and the photoconductive drum 131, the positively charged toner image on the outer circumferential surface of the photoconductive drum 131 is attracted to the front surface of the negatively charged sheet P having reached the position right below the photoconductive drum 131 to be separated from the photoconductive drum 131. After the toner image is transferred to the sheet P in this way, the sheet P is fed to the image fixing unit 14 by the turning movement of the conveyance belt 136.

The cleaning device 137 is provided to clean the outer circumferential surface of the photoconductive drum 131 by removing the residual toner after the image transferring operation.

The charge remover 138 is for removing the electric charges residual on the outer circumferential surface of the photoconductive drum 131. The outer circumferential surface of the photoconductive drum 131 having the residual electric charges removed by this charge remover 138 moves to the charger 132 again for a next image forming operation.

The image fixing unit 14 is for fixing the toner image transferred to the sheet P in the image forming unit 13 by heating while conveying the sheet P along a specified conveyance path. A discharging conveyance path 141 is provided at a downstream side of the image fixing unit 14, and the sheet P having the toner image fixed thereto is discharged to the discharging unit 15 via this discharging conveyance path 141.

The discharging unit 15 has a discharge tray 151 having an arcuate upper surface, and the sheet P discharged via the discharging conveyance path 141 is placed on the discharge tray 151.

Next, the construction of the image fixing unit 14 according to this embodiment is described in detail with reference to FIGS. 2 to 6.

Figure 2:
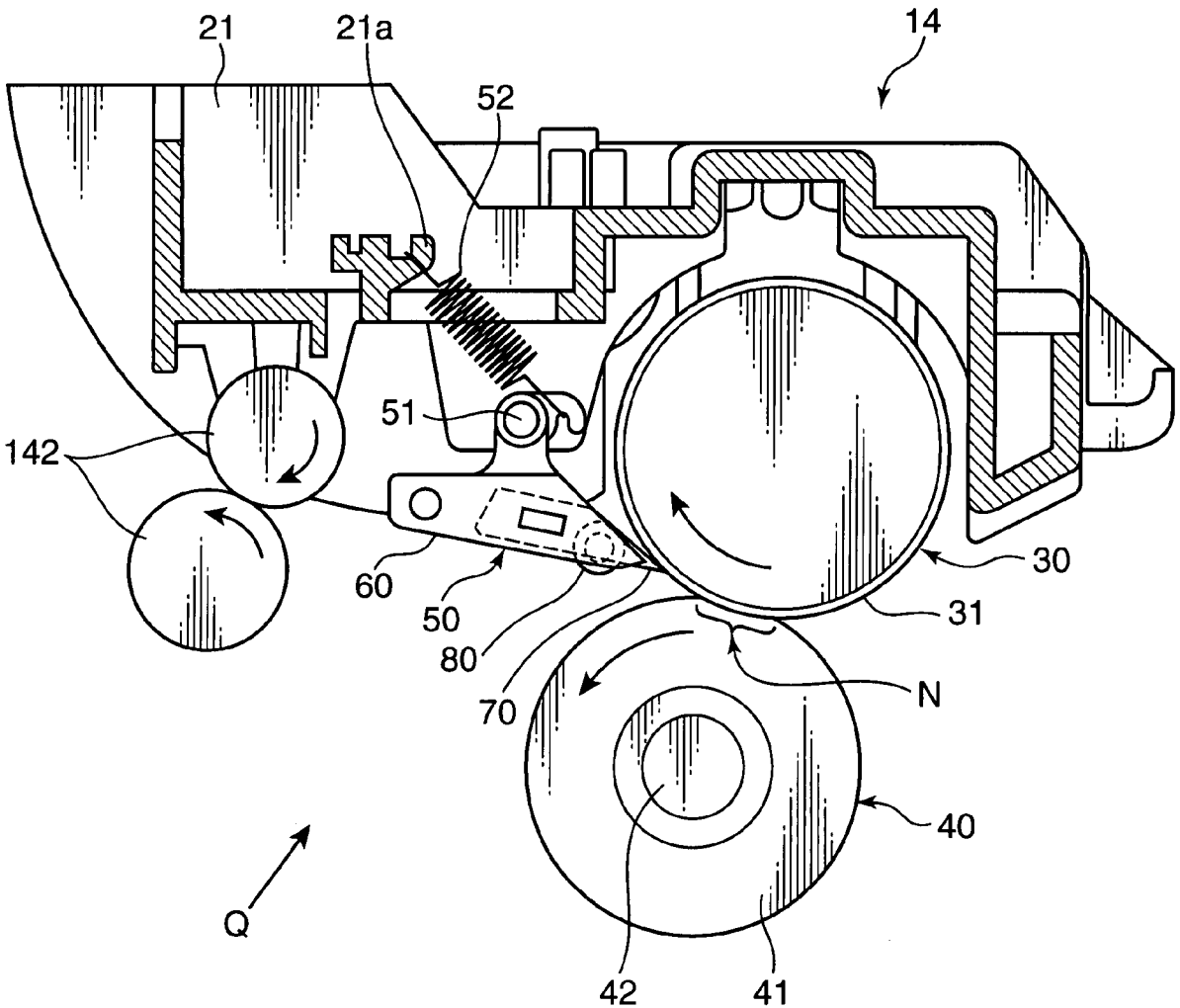
FIG. 2 is a front view showing the construction of the image fixing unit shown in FIG. 1.
Figure 3:
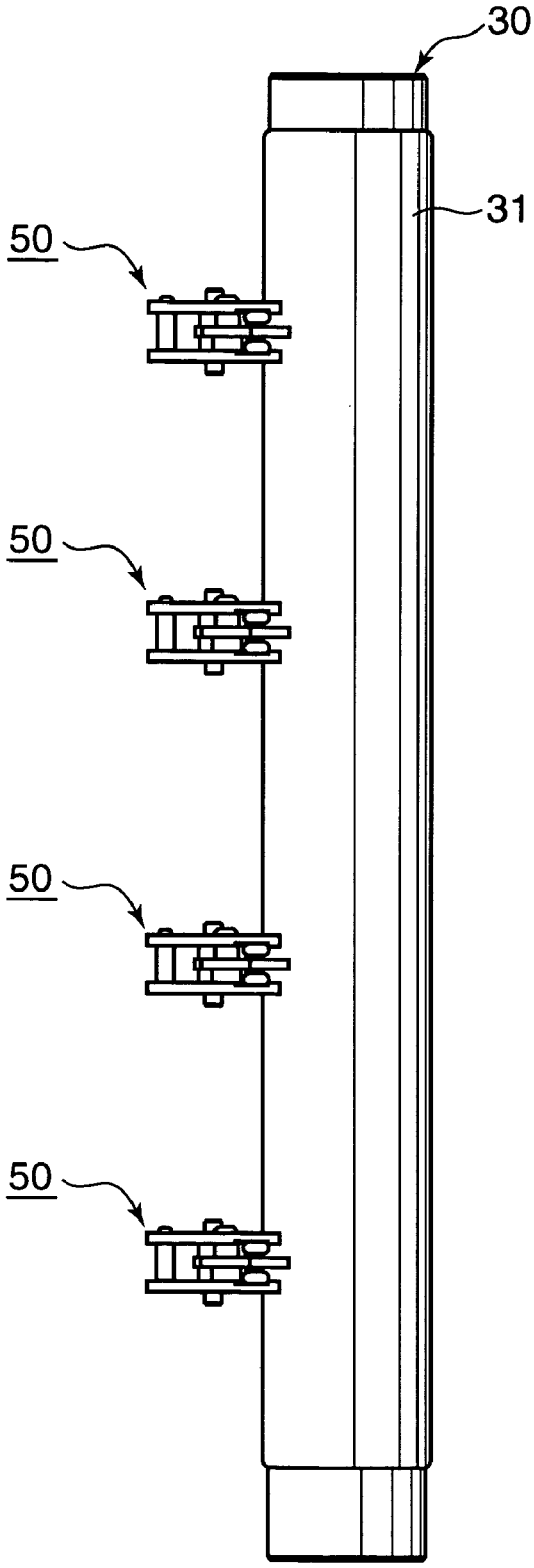
FIG. 3 is a view showing a fixing roller of the image fixing unit shown in FIG. 2 and a separating mechanism according to a first embodiment of the invention when viewed in a direction of arrow Q of FIG. 2.

As shown in FIG. 2, the image fixing unit 14 is constructed such that a fixing (heat) roller 30 capable of evolving heat and a pressure (press) roller 40 disposed below the fixing roller 30 in such a manner that the outer circumferential surface thereof faces that of the fixing roller 30 are arranged in a casing 21. The sheet P after the image transferring operation is heated by the fixing roller 30 to have the toner image fixed thereto by passing a nip area N between the fixing roller 30 rotating clockwise and the pressure roller 40 driven counterclockwise.

This fixing roller 30 is comprised of an outer tubular element 31 formed by coating the outer circumferential surface of a metallic tubular element with a specified material, and a halogen lamp or a like heat source (not shown) mounted in the outer tubular element 31. An unillustrated ring gear is fixed to one end of this outer tubular element 31. The driving rotation of a motor (not shown) disposed at a specified position outside the casing 21 is transmitted to the ring gear via a gear mechanism or the like, whereby the outer tubular element 31 is drivingly rotated about a central axis thereof.

The pressure roller 40 is comprised of a tubular roller main body 41, and a roller shaft 42 arranged concentrically with the roller main body 41 and penetrating through end walls of the roller main body 41. This pressure roller 40 is pressed against the outer circumferential surface of the outer tubular element 31 of the fixing roller 31 by a biasing force of unillustrated biasing means in the nip area N, thereby being driven by the fixing roller 31.

In such an image fixing unit 14, four (see FIG. 3) separating mechanisms 50 for separating the sheet P trying to wind around the outer circumferential surface of the fixing roller 30 from the outer circumferential surface of the fixing roller 30 are arranged side by side at specified intervals along the longitudinal direction of the fixing roller 30 at an exit side of the casing 21. It should be noted that the separating mechanisms 50 are one example of "separating means" of the present invention. Further, as shown in FIG. 2, a pair of discharging rollers 142 for conveying the sheet P after the fixing operation toward the discharging conveyance path 141 are disposed at a downstream side (left side in FIG. 2) of the separating mechanisms 50.

In the image fixing unit 14 of this embodiment, a path from the nip area N between the fixing roller 30 and the pressure roller 40 to the pair of discharging rollers 142 corresponds to a "conveyance path" of the present invention. On this conveyance path, the sheet P is conveyed by the fixing roller 30 and the pressure roller 40 until the leading end thereof reaches the pair of discharging rollers 142 after passing the nip area N. Further, the fixing roller 30 and the pressure roller 40 are synchronized with the pair of discharging rollers 142 to convey the sheet P until the trailing end of the sheet P passes the nip area N after the leading end of the sheet P reaches the pair of discharging rollers 142. The sheet P is conveyed only by the pair of discharging rollers 142 after the trailing end of the sheet P passes the nip area N.

As shown in FIG. 2, each separating mechanism 50 includes a holder member 60 disposed rotatably about a supporting shaft 51, a separating claw 70 fixedly held in the holder member 60, a pair of roller members 80 (see FIG. 4) rotatably held in the holder member 60, and a tension coil spring 52 for biasing the holder 60 in a specified direction. It should be noted that the separating claw 70 is one example of a "claw member" of the present invention, and the roller members 80 are one example of "rotary members" of the present invention.

Figure 4:
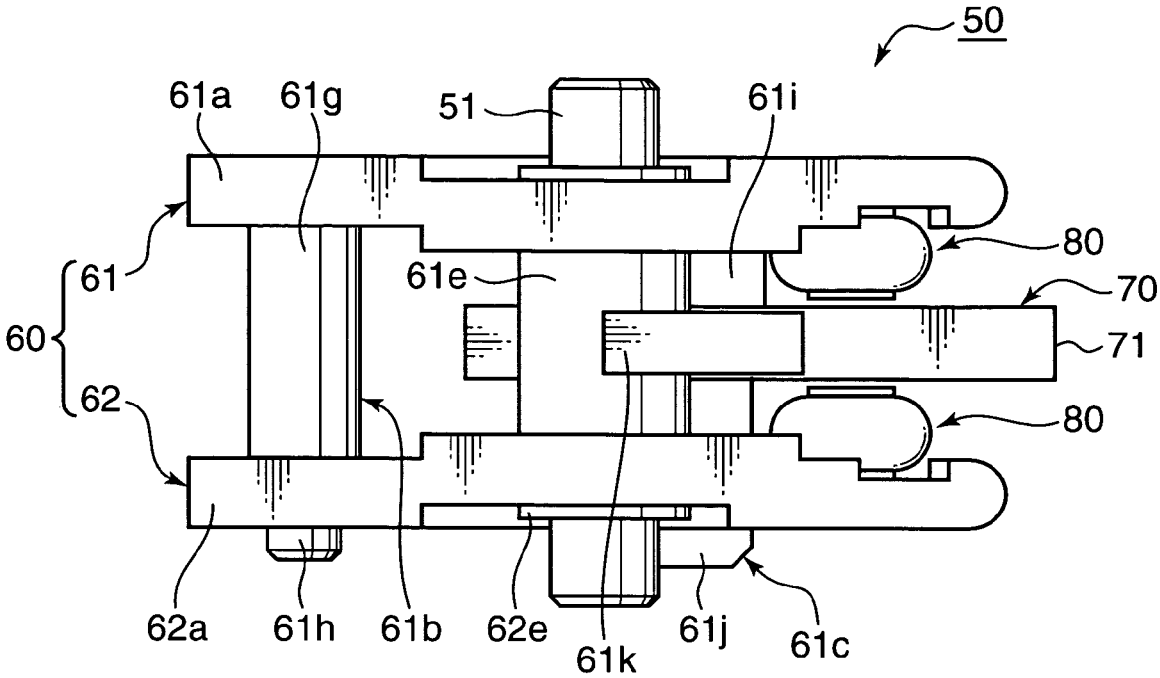
FIG. 4 is a plan view showing the construction of the separating mechanism according to the first embodiment.

The holder member 60 is so disposed as not to touch the fixing roller 30 and shaped to be able to embrace the separating claw 70 and the roller members 80. This holder member 60 includes a first holder 61 having a male structure and a second holder 62 having a female structure as shown in FIGS. 4 and 5.

Figure 5:
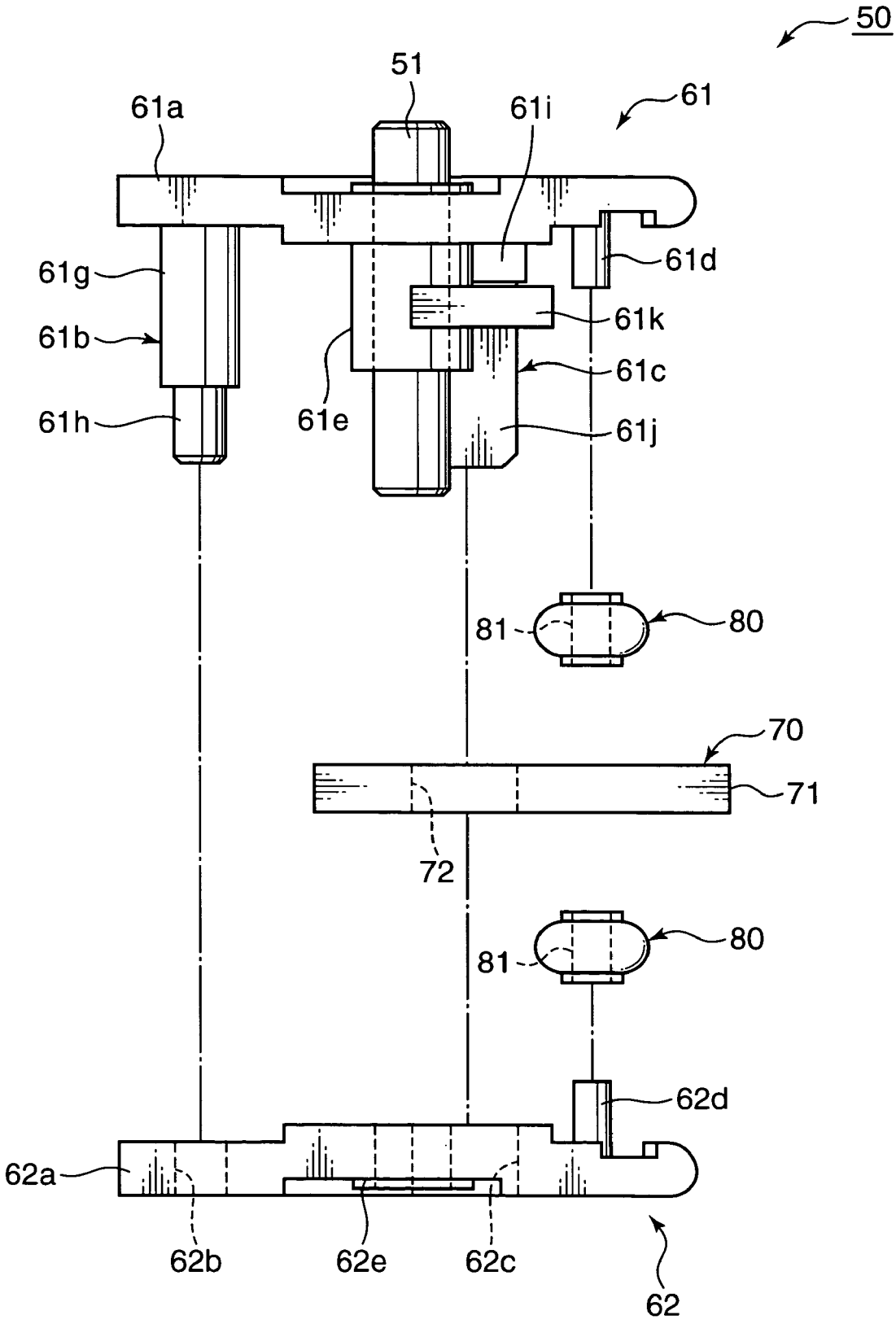
FIG. 5 is a plan view showing an exploded state of the separating mechanism shown in FIG. 4.

As shown in FIG. 5, the first holder 61 is comprised of a side plate 61*a*; a first projection 61*b*, a second projection 61*c* and a column 61*d* formed on a surface of the side plate 61 facing the second holder 62; and a tubular shaft inserting portion 61*e* formed at an upper part of the side plate 61*a*. It should be noted that the second projection 61*c* is one example of a "first holding portion" of the present invention and the column 61*d* is one example of "a second holding portion" of the present invention.

The second holder 62 is comprised of a side plate 62*a*; a first hole 62*b* and a second hole 62*c* formed at positions of the side plate 62*a* corresponding to the first and second projections 61*b*, 61*c*; a column 62*d* formed on a surface of the side plate 62 facing the first holder 61; and a shaft inserting portion 62*e* formed at an upper part of the side plate 62*a* in correspondence with the shaft inserting portion 61*e*. It should be noted that the column 62*d* is also one example of the "second holding portion" of the present invention.

Figure 6:
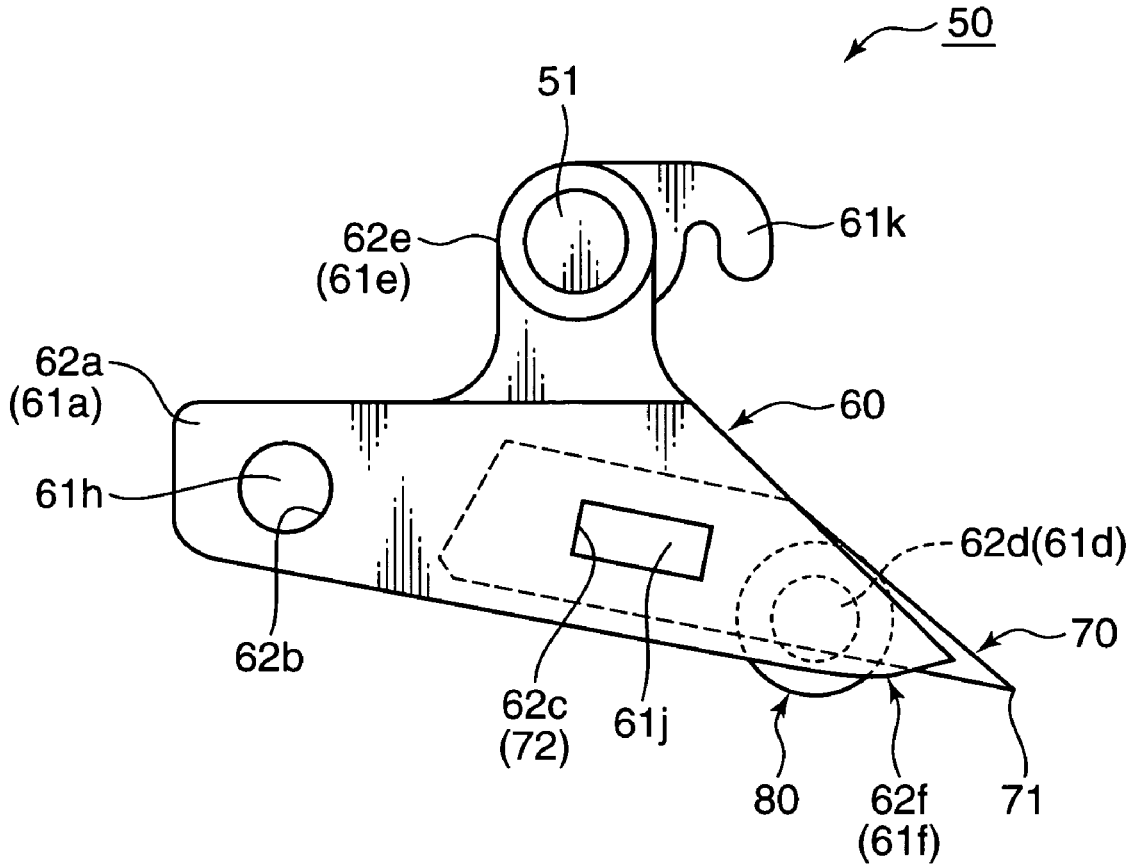
FIG. 6 is a front view of the separating mechanism according to the first embodiment.

In this embodiment, each of the side plates 61*a*, 62*a* is formed to have a laterally long front view, and has a guiding portion 61*f*, 62*f* at a bottom part of an upstream side thereof with respect to the conveyance path as shown in FIG. 6. These guiding portions 61*f*, 62*f* are provided to smoothly guide the leading end of the sheet P to the roller members 80 on the conveyance path for the sheet P between the separating claw 70 and the roller members 80. In other words, the leading end of the sheet P separated from the outer circumferential surface of the fixing roller 30 by the separating claw 70 has its direction of conveyance (path) gradually corrected by being guided by the guiding portions 61*f*, 62*f*, thereby being able to smoothly come into contact with the outer circumferential surfaces of the roller members 80 in direction tangent to such outer circumferential surfaces.

The first projection 61*b* is for fixing the respective holders 61, 62 while spacing them apart by a specified distance. Specifically, the first projection 61*b* includes a cylindrical base portion 61*g* and a press-in portion 61*h* having a smaller diameter than the base portion 61*g* and to be pressed into the first hole 62*b* of the second holder 62 as shown in FIGS. 4 and 5. The side plates 61*a*, 62*a* can be held spaced apart by a distance equal to the longitudinal length of the base portion 61*g* by the contact of the base portion 61*g* of the first projection 61*b* with the side plate 62*a* of the second holder 62.

The second projection 61*c* is for fixedly holding the separating claw 70. Specifically, the second projection 61*c* extends in such a direction as to bridge the side plates 61*a*, 62*a* arranged in parallel, and includes a position defining portion 61*i* having a rectangular cross section and a holding portion 61*j* having a cross section one size smaller than that of the position defining portion 61*i* and to be pressed successively into an opening 72 of the separating claw 70 to be described later and the second hole 62*c* of the second holder 62. The separating claw 70 is prevented from moving greater than a specified distance in a direction toward the side plate 61*a* of the first holder 61 by the contact of the position defining portion 61*i* with the separating claw 70. The separating claw 70 pressed in the holding portion 61*j* while having the position thereof defined by the position defining portion 61*i* of the second projection 61*c* is located at a substantially middle position between the side plates 61*a* and 62*a* as shown in FIG. 4.

The columns 61*d*, 62*d* are so arranged as to face each other as shown in FIG. 5, and rotatably hold the roller members 80. These columns 61*d*, 62*d* project from the respective side plates 61*a*, 62*a* by such amounts as not to touch the separating claw 70 fixedly held on the holding portion 61*j* of the second projection 61*c*.

As shown in FIG. 4, the shaft inserting portions 61*e*, 62*e* are so arranged as to be adjacent to each other when the respective holders 61, 62 are assembled, and the supporting shaft 51 for rotatably supporting the holding member 60 is inserted thereinto. A hook 61*k* used to mount one end of the tension coil spring 52 (see FIG. 2) is integrally formed at an upper part of the shaft inserting portion 61*e*.

Such a holder member 60 is preferably made of a heat resistant resin having a good heat resistance such as a polyether ketone (PEK), a polyimide (PI) or a polyphenylene sulfide (PPS).

As shown in FIGS. 4 to 6, each separating claw 70 is for separating the sheet P from the fixing roller 30, and has an acute-angled tip portion 71 (see FIG. 6) which comes into contact with the outer circumferential surface of the fixing roller 30, and the opening 72 (see FIG. 5) which is rectangular in front view and into which the second projection 61*c* of the holder member 60 is pressed. As described above, the separating claw 70 is so arranged as to be located at the substantially middle position between the side plates 61*a* and 62*a* of the respective holders 61 and 62 and to cause the tip portion 71 to project outward (toward the outer circumferential surface of the fixing roller 30) from an upstream end (right side in the drawing) of the holder member 60 with respect to the conveyance path. Further, the tip portion 71 is held in contact with the outer circumferential surface of the fixing roller 30 by a tensile force of the tension coil spring 52 at a position at a specified distance L1 (see FIG. 7) from a downstream end (hereinafter, referred to as a "nip area exit") of the nip area N with respect to the conveyance direction.

It is preferable that at least the outer surface of the separating claw 70 is made of a fluoroplastic having a higher heat resistance than the material of the holder member 60. For example, if the holder member 60 is made of a polyphenylene sulfide (PPS), the outer surface of the separating claw 70 is preferably coated with a tetrafluoroethylene-perfluoroalkoxyethylene copolymer (PFA).

The pair of roller members 80 are disposed downstream of the tip portion 71 of the separating claw 70 with respect to the conveyance path. As shown in FIG. 5, the roller members 80 are rotatably mounted on the columns 61*d*, 62*d* by inserting the columns 61*d*, 62*d* into shaft holes 81, thereby sandwiching the separating claw 70 between the side plates 61*a* and 62*a*. Each roller member 80 is held on the column 61*d* (62*d*) with a specified play defined to the separating member 70 in the projecting direction of the column 61*d* (62*d*) so as to be movable away from the separating claw 70. Further, as shown in FIG. 6, the roller members 80 are formed such that the outer circumferential surfaces thereof are partially exposed outward (into the conveyance path) from the bottom end of the holder member 60 while being held in the holder member 60.

The outer surfaces of the roller members 80 are coated with a fluoroplastic such as a tetrafluoroethylene-perfluoroalkoxyethylene copolymer (PFA) or tetrafluoroethylene resin (PTFE) and have a good heat resistance and a lower friction coefficient with the sheet P. Thus, it is possible to considerably reduce physical loads given to the image on the sheet P when the roller members 80 guide the sheet P to the downstream side along the conveyance path while being rotated. It should be noted that the roller members 80 may be entirely made of the above fluoroplastic.

The tensile coil spring 52 is provided to bias the holder member 60 to bring the tip portion 71 of the separating claw 70 into contact with the outer circumferential surface of the fixing roller 30 as shown in FIG. 2. The other end of the tensile coil spring 52 is engaged with an engaging portion 21*a* formed in the casing 21 of the image fixing unit 14. The holder member 60 is rotated in a specified direction (counterclockwise direction in the drawing) by the tensile force of the tensile coil spring 52, whereby the tip portion 71 of the separating claw 70 is pressed against the outer circumferential surface of the fixing roller 30.

In the separating mechanism 50 having the above construction, the guiding portions 61*f*, 62*f* of the holder member 60 are located between the tip portion 71 of the separating claw 70 projecting outward from the upstream end of the holder member 60 with respect to the conveyance path and the roller members 80 exposed to the outside from the bottom end of the holder member 60 when viewed from front as shown in FIG. 6.

Figure 7:
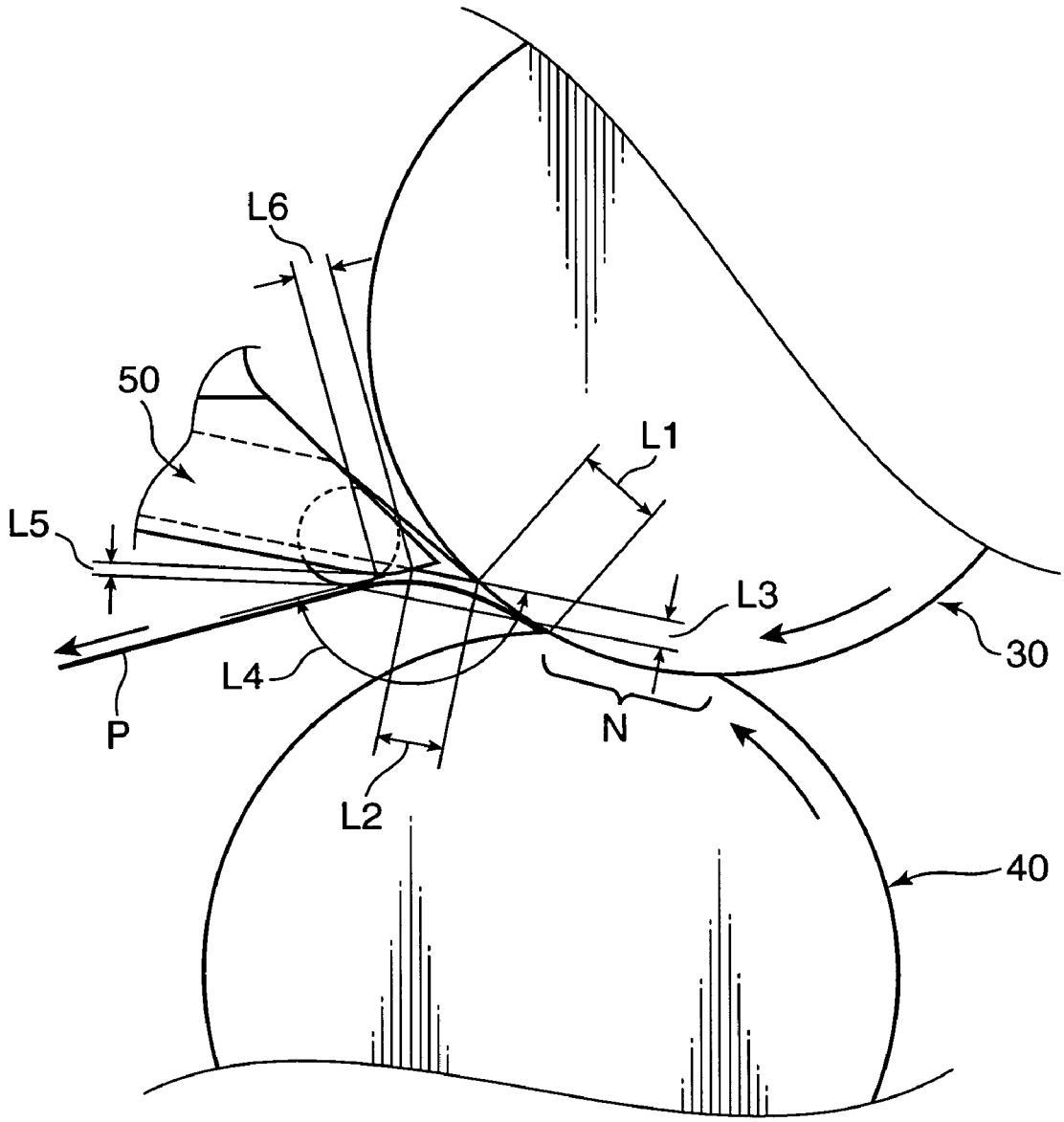
FIG. 7 is a schematic view showing a conveyance path for a sheet in the image fixing unit shown in FIG. 2.

Here, the construction (arranged position and dimensions) of the separating mechanism 50 of this embodiment is described in detail with reference to FIGS. 6 and 7. It should be noted that only main components are identified by reference numerals in order to avoid confusion caused by too many reference numerals. As shown in FIG. 7, the separating mechanism 50 has a parameter L1 concerning the arranged position of the separating mechanism 50 and five parameters L2 to L6 concerning dimensions of the separating mechanism 50 based on a positional relationship with the components (holder member 60, separating claw 70 and roller members 80).

The parameter L1 indicates a distance between the nip area exit and the tip portion 71 of the separating claw 70 as described above. This distance L1 is preferably equal to or longer than about 2.0 mm and equal to or shorter than about 6.0 mm. If the distance L1 is longer than about 6.0 mm, adherence of the toner on the sheet P to the fixing roller 30 increases while the sheet P is conveyed from the nip area exit to the tip portion 71 of the separating claw 70, whereby it becomes difficult to separate the sheet P from the fixing roller 30 and the toner on the sheet P is excessively molten. Thus, a tendency to create striped color shading in the image and to be unable to obtain the image as desired becomes eminent. Further, if the distance L1 is shorter than about 2.0 mm, the tip portion 71 of the separating claw 70 comes into contact with the outer circumferential surface of the pressure roller 40 with a higher possibility due to a variation of the nip area N between the two rollers 30 and 40 caused by heat and drive.

The parameter L2 indicates a distance between the tip portion 71 of the separating claw 70 and a point where the sheet P is transferred from the separating claw 70 to the guiding portions 61*f*, 62*f*. This distance L2 is preferably equal to or longer than about 1.0 mm and equal to or shorter than about 5.0 mm for the following reasons. If the distance L2 is longer than about 5.0 mm, it becomes difficult to let the sheet P bridge between the nip area exit and the guiding portions 61*f*, 62*f*, whereby the sheet P becomes more likely to touch the separating claw 70. If the distance L2 is shorter than about 1.0 mm, the leading end of the sheet P fed from the nip area exit N gets caught by the guiding portions 61*f*, 62*f* due to its elasticity, whereby the normal conveyance of the sheet P tends to become eminently difficult.

The parameter L3 indicates a distance between a surface of the separating claw 70 used to convey the sheet P and bottommost positions of the roller members 80. This distance L3 is preferably equal to or longer than about 0.5 mm and equal to or shorter than about 4.0 mm for the following reasons. If the distance L3 is longer than about 4.0 mm, the direction of conveyance (path) of the sheet P largely changes, therefore the sheet P undergoes the aforementioned "pull-back" and comes into contact with the separating claw 70 with a higher possibility. If the distance L3 is shorter than about 0.5 mm, it becomes difficult to let the sheet P bridge between the nip area exit and the guiding portions 61*f*, 62*f*, therefore the sheet P comes into contact with the separating claw 70 with a higher possibility.

The parameter L4 indicates an angle between the surface of the separating claw 70 used to convey the sheet P and a tangent to the guiding portions 61*f*, 62*f* at the point where the sheet P is transferred from the separating claw 70 to the guiding portions 61*f*, 62*f*. This angle L4 is preferably equal to or larger than about 135 degrees and equal to or smaller than about 175 degrees for the following reasons. If the angle L4 is larger than about 175 degrees, it becomes difficult to ensure a step between the surface of the separating claw 70 used to convey the sheet P and the guiding portions 61*f*, 62*f*, making it difficult to let the sheet P bridge between the nip area exit and the guiding portions 61*f*, 62*f* similar to the case where the parameter L3 falls below the lower limit. Therefore, the sheet P comes into contact with the separating claw 70 with a higher possibility. If the angle L4 is smaller than about 135 degrees, the direction of conveyance (path) of the sheet P largely changes as in the case where the parameter L3 exceeds the upper limit. Therefore, the sheet P undergoes the aforementioned "pull-back" and comes into contact with the separating claw 70 with a higher possibility.

The parameter L5 indicates a distance between the bottommost positions of the guiding portions 61*f*, 62*f* and the bottommost positions of the roller members 80. This distance L5 is preferably equal to or longer than about 0.5 mm and equal to or shorter than about 3.0 mm for the following reasons. If the distance L5 is longer than about 3.0 mm, the direction of conveyance (path) of the sheet P largely changes, whereby the sheet P undergoes "pull-back), making it highly possible to press the sheet P against the guiding portions 61*f*, 62*f* or bringing the sheet P into contact with the separating claw 70. Further, if the distance L5 is shorter than about 0.5 mm, the sheet P is conveyed while being constantly held in sliding contact with the guiding portions 61*f*, 62*f*, therefore a tendency to create an image abrasion (guiding traces) on the outer surface of the image on the sheet P and to adhere the toner to the guiding portions 61*f*, 62*f* becomes eminent.

The parameter L6 indicates a distance between the point where the sheet P is transferred from the separating claw 70 to the guiding portions 61*f*, 62*f* and a point where the sheet P is transferred from the guiding portions 61*f*, 62*f* to the roller members 80. This distance L6 is preferably equal to or longer than about 0.5 mm and equal to or shorter than about 3.0 mm for the following reasons. If the distance L6 is longer than about 3.0 mm, it becomes difficult to let the sheet P bridge between the nip area exit and the rollers 80, therefore the sheet P comes into contact with the guiding portions 61*f*, 62*f* with a higher possibility. Further, if the distance L6 is shorter than about 0.5 mm, the direction of conveyance (path) of the sheet P largely changes, therefore the sheet P undergoes the aforementioned "pull-back" and the sheet P comes into contact with the separating claw 70 with a higher possibility.

In the image fixing unit 14 including the separating mechanisms 50 thus constructed, the leading end of the sheet P separated from the fixing roller 30 by the separating claws 70 is guided by the separating claws 70 in the vicinity of the tip portions 71 of the separating claws 70. On the other hand, the leading end of the sheet P is guided by the guiding portions 61*f*, 62*f* of the holder 60 at a side downstream of a position at a specified distance from and downstream of the tip portions 71 with respect to the conveyance path, and is guided by the outer circumferential surfaces of the roller members 80 at a further downstream side. In other words, the members guiding the leading end of the sheet P are successively switched from the separating claws 70, to the guiding portions 61*f*, 62*f* of the holder members 60 and to the roller members 80.

When the leading end of the sheet P is guided by the guiding portions 61*f*, 62*f*, the sheet P bridges between the nip area exit and the guiding portions 61*f*, 62*f*, therefore there is no likelihood that the sheet P comes into contact with the separating claws 70. When the leading end of the sheet P reaches the roller members 80 and the sheet P is guided by the outer circumferential surfaces of the roller members 80, the sheet P bridges between the nip area exit and the outer circumferential surfaces of the roller members 80, therefore there is no likelihood that the sheet P comes into contact with the guiding portions 61*f*, 62*f* and the separating claws 70.

The holder members 60 and the separating claws 70 are formed by separate members. Thus, even if the separating claws 70 reach a high temperature due to the contact with the fixing roller 30, the holder members 60 are kept at a temperature lower than the separating claws 70. As a result, the roller members 80 rotatably mounted in the holder members 60 are kept at a temperature even lower than the holder members 60. For example, if the temperature of the fixing roller 30 is about 190° C., a temperature at parts of the separating claws 70 in contact with the sheet P is about 180° C. and a temperature at parts of the guiding portions 61*f*, 62*f* of the holder members 60 in contact with the sheet P is about 125° C. Further, a temperature at the outer circumferential surfaces of the roller members 80 at this time is thought to be even lower than about 125° C.

Figure 24:
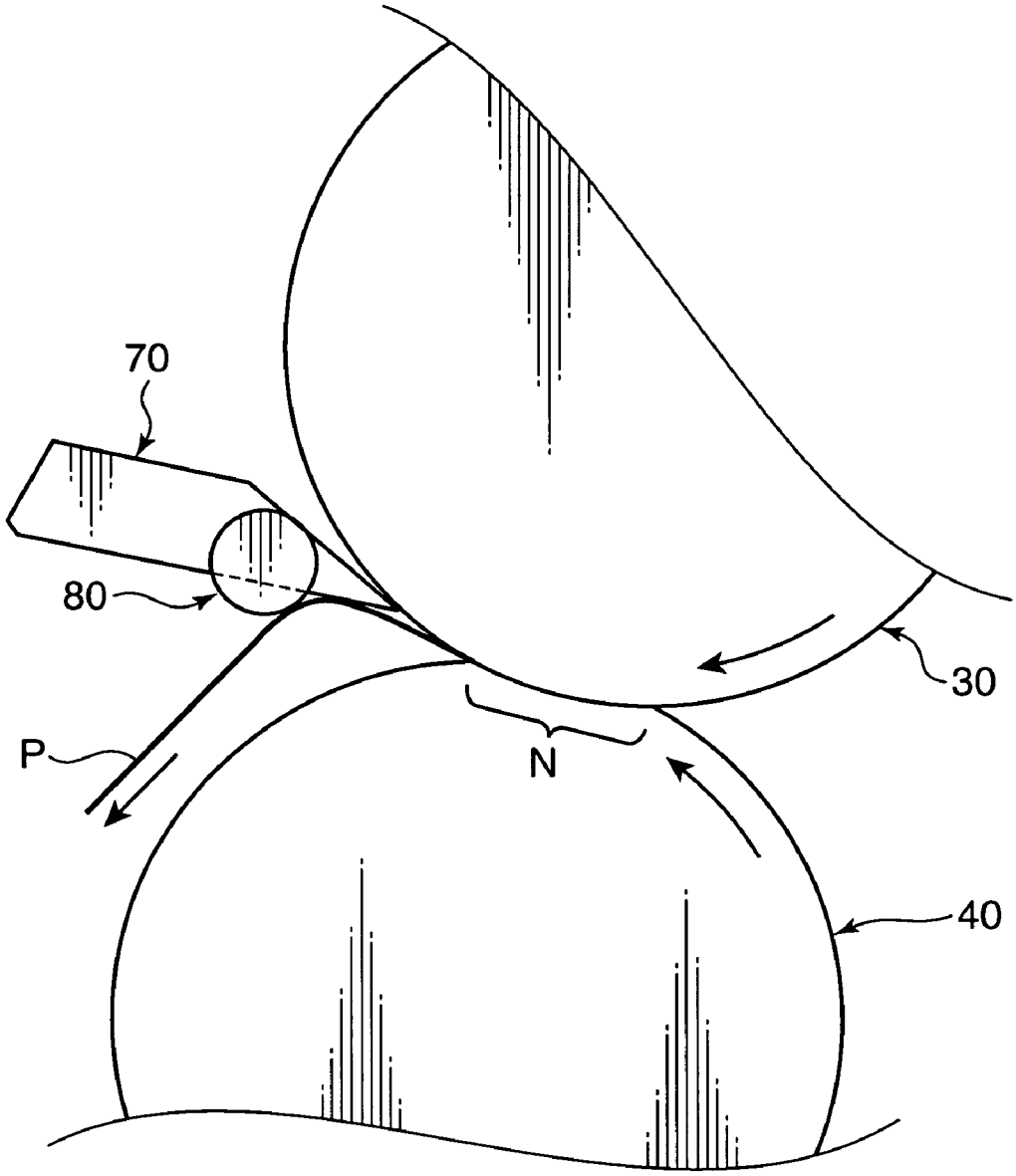
PRIOR ART FIG. 24
FIG. 24 is a schematic view showing a conveyance path for a sheet in an image fixing unit as a comparative example.

According to the construction of the first embodiment described above, by providing the guiding portions 61*f*, 62*f* for guiding the sheet P to the roller members 80 on the conveyance path between the separating claws 70 and the roller members 80, the sheet P separated from the fixing roller 30 can be actively guided to the roller members 80 by the guiding portions 61*f*, 62*f*. Accordingly, even if the separating claws 70 and the roller members 80 are arranged in such a positional relationship as to largely change the direction of conveyance (path) of the separated sheet P, the members for guiding the sheet P smoothly switch from the separating claws 70 to the roller members 80 via the guiding portions 61*f*, 62*f* as shown in FIG. 7 unlike the case where the members for guiding the separated sheet P switch only from the separating claws 70 to the roller members 80 (see FIG. 24). Thus, the sheet P can be smoothly brought into contact with the outer circumferential surfaces of the roller members 80 while suppressing a large change in the direction of conveyance of the sheet P. Since loads exerted on the sheet P can be reduced in this way, an occurrence of scratching the sheet P by the contact of a part of the sheet P with the separating claws 70 due to the "pull-back" of the sheet P can be suppressed. Therefore, a reduction in image quality can be suppressed.

In this embodiment, by providing the guiding portions 61*f*, 62*f* on the conveyance path between the separating claws 70 and the roller members 80, the sheet P separated from the fixing roller 30 can be transferred from the separating claws 70 onto the guiding portions 61*f*, 62*f* of the holder members 60 having a temperature lower than and provided separately from the separating claws 70 having a high temperature, and can be guided to the downstream side along the conveyance path by the guiding portions 61*f*, 62*f* having a lower temperature. Since a contact period of the sheet P with the separating claws 70 having a high temperature due to the contact with the outer circumferential surface of the fixing roller 30 can be shortened, the melting (remelting) of the toner on the sheet P separated from the fixing roller 30 can be suppressed. Since this can also act to hinder the separating claws 70 from scratching the image formed on the sheet P, a reduction in image quality can be suppressed. Particularly in the case where the guiding portions 61*f*, 62*f* are disposed at positions relatively close to the tip portions 71 of the separating claws 70, the sheet P separated from the fixing roller 30 can be transferred from the separating claws 70 to the guiding portions 61*f*, 62*f* at the positions relatively close to the tip portions 71 of the separating claws 70, which are separating positions. Therefore, the contact period of the sheet P with the separating claws 70 having a high temperature can be further shortened.

Further, the guiding portions 61*f*, 62*f* are provided on the conveyance path between the tip portions 71 of the separating claws 70 and the roller members 80 and are caused to guide the sheet P to the roller members 80. Thus, even if the separated sheet P is conveyed while being pressed against the guiding portions 61*f*, 62*f* by the elasticity thereof and the guiding portions 61*f*, 62*f* are provided in the vicinity of the tip portions 71 of the separating claws 70, it is guided at the downstream side of the conveyance path while the roller members 80 are rotated. Thus, a degree of contact of the sheet P with the guiding portions 61*f*, 62*f* can be sufficiently moderated. Therefore, an occurrence of image abrasion on the outer surface of the image on the sheet P can be sufficiently suppressed.

The guiding portions 61*f*, 62*f* are so constructed as to guide the leading end of the sheet P separated from the fixing roller 30 by the separating claws 70 toward the outer circumferential surfaces of the roller members 80. By having such a construction, the leading end of the sheet P separated from the fixing roller 30 can be actively guided toward the circumferential surfaces of the roller members 80, therefore the leading end of the sheet P conveyed while being held in contact with the separating claws 70 and the guiding portions 61*f*, 62*f* after the separation can be smoothly brought into contact with the outer circumferential surfaces of the roller members 80 to reduce the loads exerted on the leading end of the sheet P. This can further hinder the separating claws 70 from scratching the sheet P due to the contact of the part of the sheet P with the separating claws 70 caused by the "pull-back" of the sheet P, therefore a reduction in image quality can be sufficiently suppressed.

In this embodiment, the holder members 60 are so arranged as not to touch the fixing roller 30, such that the temperature of the contact parts of the guiding portions 61*f*, 62*f* with the sheet P is lower than that of the contact parts of the separating claws 70 with the sheet P in an operative state of the printer 10. This enables the sheet P separated from the fixing roller 30 by the separating claws 70 to transfer to the guiding portions 61*f*, 62*f* of the holder members 60 having a temperature lower than the separating claws 70 and to be guided to the downstream side along the conveyance path by the guiding portions 61*f*, 62*f*, therefore the contact period of the sheet P with the separating claws 70 having a high temperature can be securely shortened. In this way, the melting (remelting) of the toner on the sheet P separated from the fixing roller 30 can be further suppressed.

Further, the roller members 80 are held on the columns 61*d*, 62*d* with the specified plays defined to the separating claws 70 in the extending directions of the columns 61*d*, 62 so as to be movable away from the separating claws 70. This enables the separating claws 70 to suitably come into contact with the roller members 80 in the extending directions of the columns 61*d*, 62*d* while being intermittently brought out of contact with the roller members 80. Thus, an excessive temperature increase of the roller members 80 can be suppressed while the roller members 80 are prevented from coming off the columns 61*d*, 62*d*. Therefore, the influence of the roller members 80 on the image on the sheet P can be reduced while hindering an increase in the number of parts.

Further, the separating claws 70 and the roller members 80 for guiding the sheet P while being rotated are positioned by the second projections 61*c* and the columns 61*d*, 62*d* of the holder members 60. Thus, even if the holder members 60, the separating claws 70 and the roller members 80 are separately formed, the roller members 80 and the guiding portions 61*f*, 62*f* can be positioned with respect to the tip portions 71 of the separating claws 70 with high precision. This enables the easy realization of such a construction as to bring the tip portions 71 of the separating claws 70 into contact with the fixing roller 30 at positions near the nip area N and to arrange the guiding portions 61*f*, 62 for guiding the sheet P to the outer circumferential surfaces of the roller member 80 at positions relatively close to and downstream of the tip portions 71 of the separating claws 70 along the conveyance path.

Although a pair of roller members 80 are arranged at the opposite sides of the separating claw 70 between the side plates 61*a* and 62*a* in the foregoing embodiment, a pair of roller members 80 may be arranged at the outer sides of the side plates 61*a*, 62*a*. In such a case, the roller members 80 can be kept at an even lower temperature since the roller members 80 do not come into contact with the separating claw 70 having a high temperature. Alternatively, one roller member 80 may be arranged at one side of the separating claw 70 between the side plates 61*a*, 62*a*.

Second Embodiment

Next, a separating mechanism according to a second embodiment of the present invention is described. In the second embodiment, the tip of the above claw member has a specified width in a rotational axis direction of the fixing roller, and one rotary member (roller member) is arranged within an area extending downstream from the tip of the claw member along the conveyance path while having this width.

Figure 8:
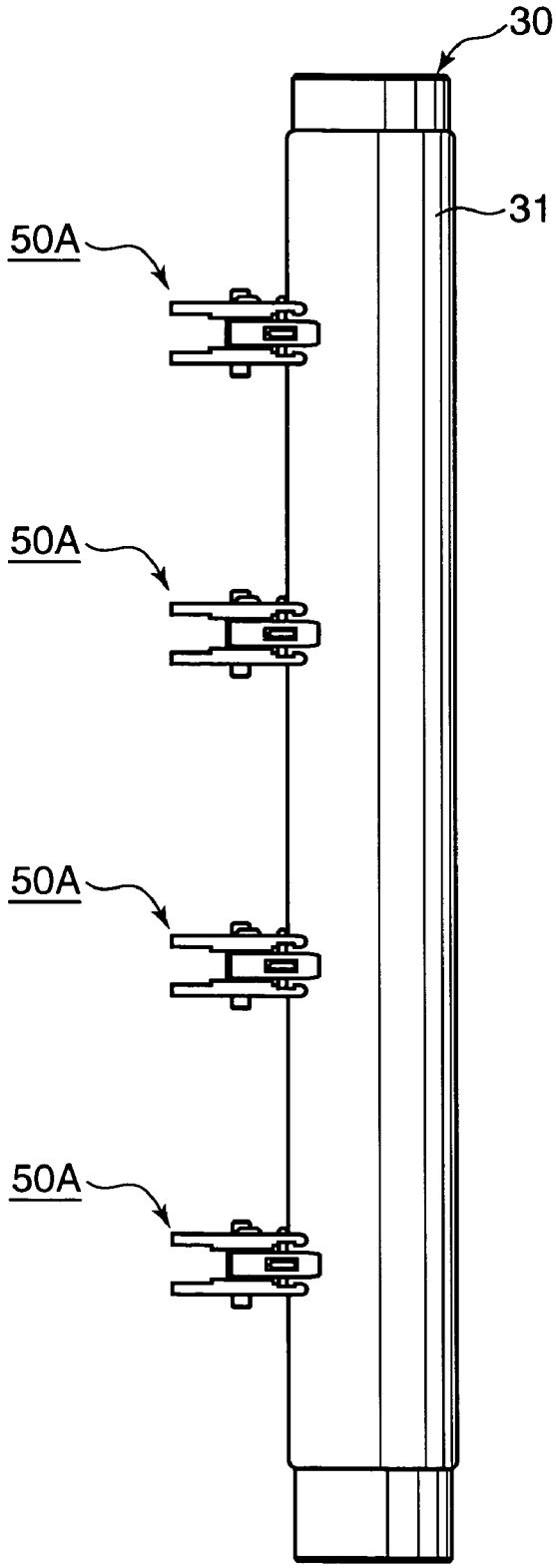
FIG. 8 a view showing the fixing roller of the image fixing unit shown in FIG. 2 and a separating mechanism according to a second embodiment of the invention when viewed in a direction of arrow Q of FIG. 2.
Figure 9:
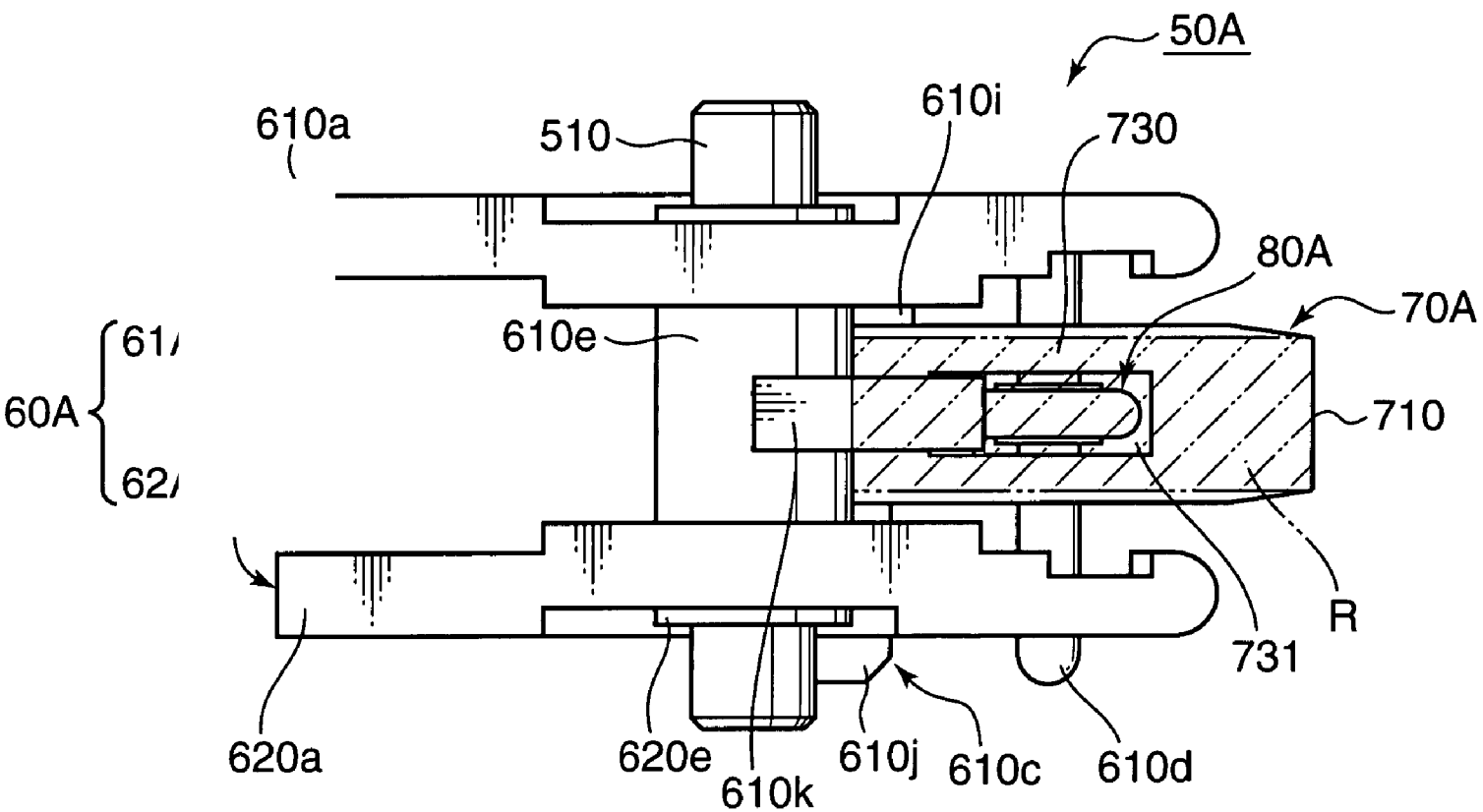
FIG. 9 is a plan view of the separating mechanism according to the second embodiment.
Figure 10:
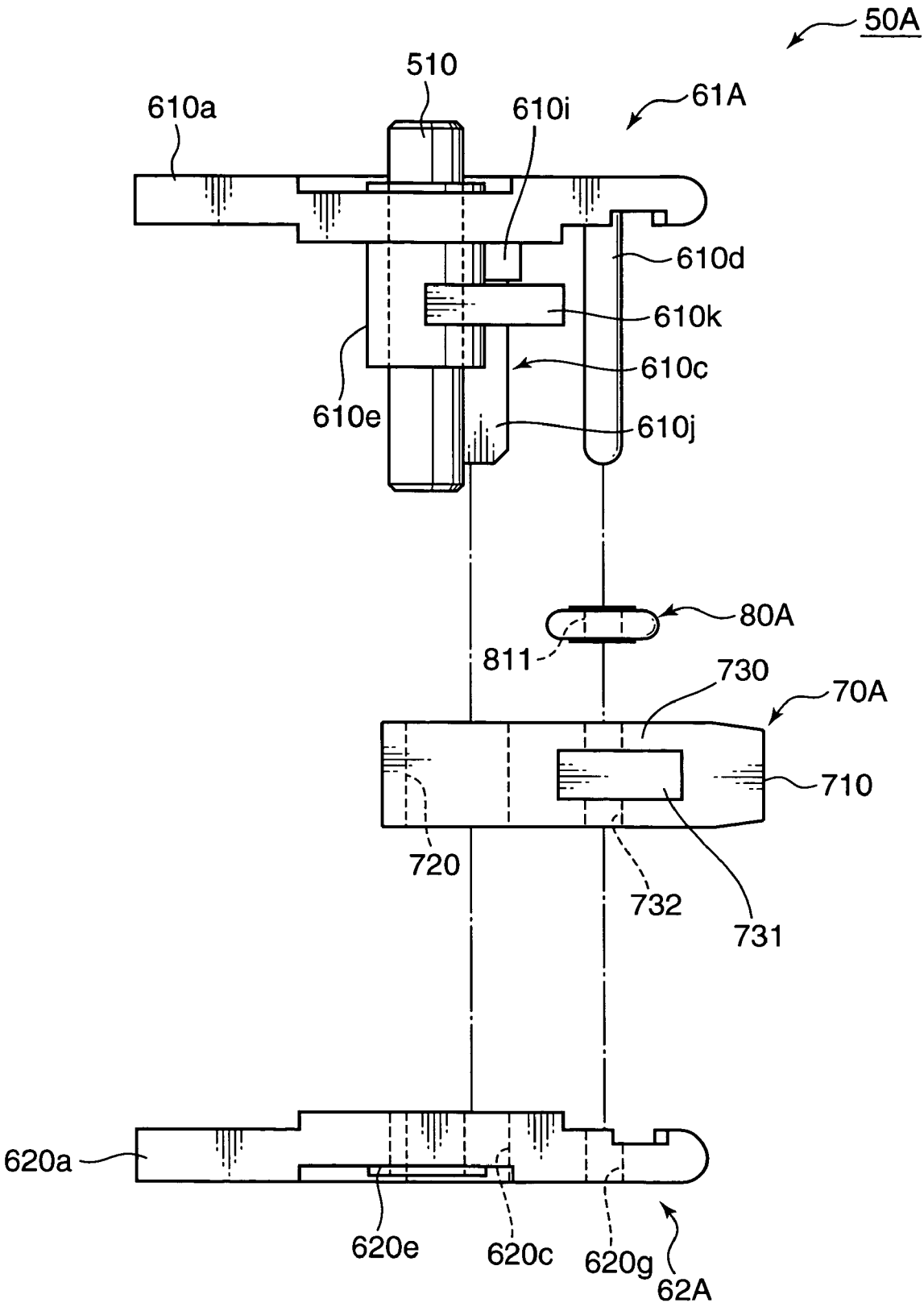
FIG. 10 is a plan view showing an exploded state of the separating mechanism shown in FIG. 9.
Figure 11:
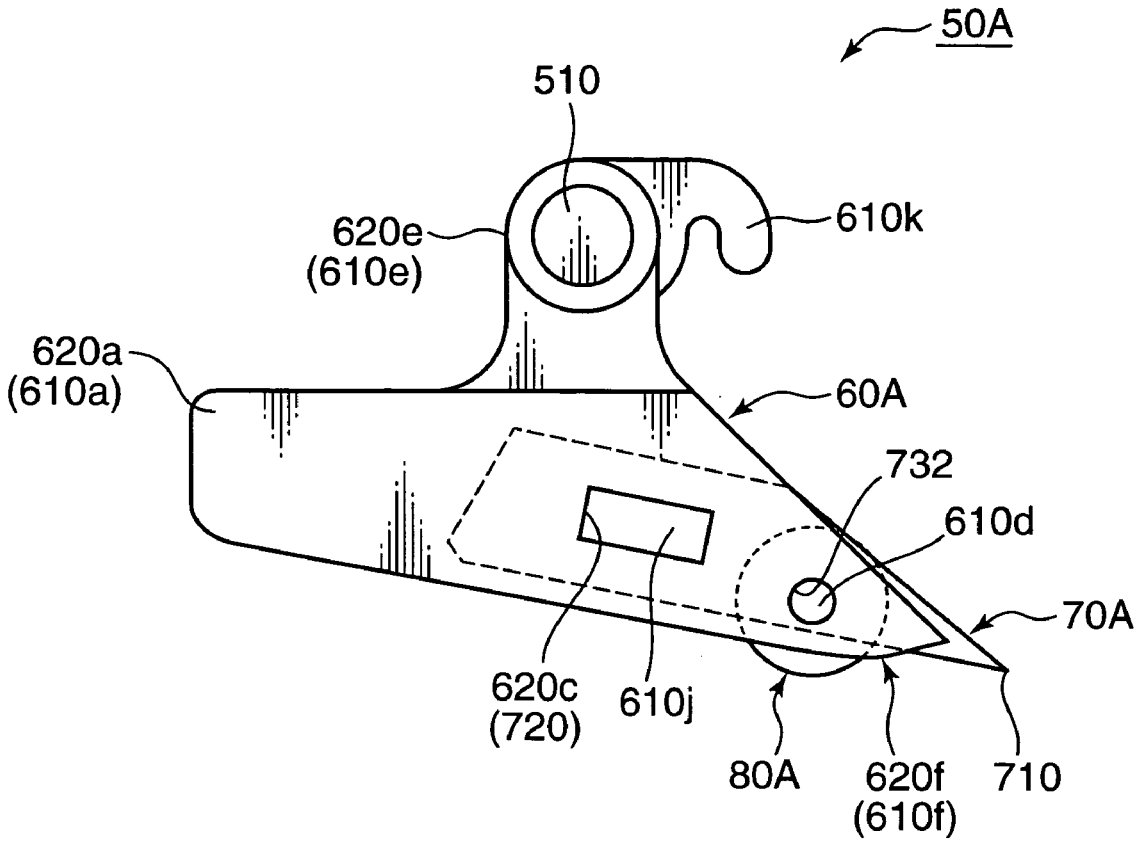
FIG. 11 is a front view of the separating mechanism according to the second embodiment.

FIG. 8 is a view showing the fixing roller 30 and the image fixing unit 14 shown in FIG. 2 and separating mechanisms 50A according to the second embodiment when viewed in the direction of arrow Q, FIG. 9 is a plan view showing the construction of the separating mechanism 50A according to the second embodiment, FIG. 10 is a plan view showing an exploded state of the separating mechanism 50A, and FIG. 11 is a front view of the separating mechanism 50A.

Similar to the separating mechanisms 50 according to the first embodiment (see FIG. 3), four separating mechanisms 50A according to the second embodiment are arranged on the outer circumferential surface of the fixing roller 30 while being spaced apart at specified intervals in the rotational axis direction of the fixing roller 30 as shown in FIG. 8. As shown in FIG. 9, each separating mechanism 50A is comprised of a holder member 60A disposed rotatably about a supporting shaft 510, a separating claw 70A fixedly held in the holder member 60A, and a roller member 80A rotatably held in the holder member 60A.

The holder member 60A is so arranged as not to touch the fixing roller 30, and so constructed as to embrace the separating claw 70A and the roller member 80A. This holder member 60A includes a first holder 61A having a male structure and a second holder 62A having a female structure as shown in FIGS. 9 and 10.

As shown in FIG. 10, the first holder 61A is comprised of a side plate 610*a*; a projection 610*c* and a column 610*d* formed on a surface of the side plate 610*a* facing the second holder 62A; and a tubular shaft inserting portion 610*e* formed at an upper part of the side plate 610*a*. Further, the second holder 62A is comprised of a side plate 620*a*; a first engaging hole 620*c* and a second engaging hole 620*g* formed at positions of the side plate 620*a* corresponding to the projection 610*c* and the column 610*d*; and a shaft inserting portion 620*e* formed at an upper part of the side plate 620*a* so as to correspond to the shaft inserting portion 610*e*.

As shown in FIG. 11, each of the side plates 610*a*, 620*a* is formed to have a laterally long front view, and has a guiding portion 610*f*, 620*f* at a bottom part of an upstream side thereof with respect to the conveyance path. These guiding portions 610*f*, 620*f* are provided to smoothly guide the leading end of a sheet P to the roller member 80A on the conveyance path for the sheet P between a tip portion 710 of the separating claw 70A and the roller member 80A.

The projection 610*c* is for fixing the respective holders 61A, 62A while spacing them apart by a specified distance. Specifically, the projection 610*c* includes a position defining portion 610*i* having a rectangular cross section and extending in such a direction as to bridge the side plate 610*a* and the 620*a* arranged in parallel, and a holding portion 610*j* having a cross section one size smaller than the position defining portion 610*i* and to be pressed successively into an opening 720 of the separating claw 70A to be described later and the first engaging hole 620*c* of the second holder 62A. The separating claw 70A is prevented from moving longer than a specified distance in a direction toward the side plate 610*a* of the first holder 61A by the contact of the position defining portion 610*i* with the separating claw 70A. The separating claw 70A pressed in the holding portion 610*j* while having the position thereof defined by the position defining portion 610*i* of the first holder 61A is located at a substantially middle position between the side plates 610*a* and 620*a* as shown in FIG. 9.

Figure 12:
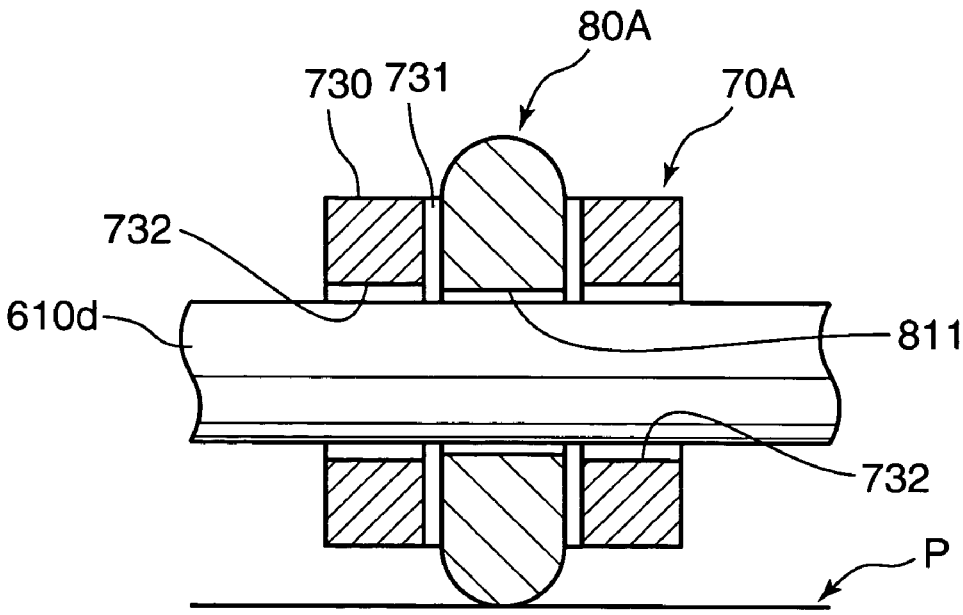
FIG. 12 is a side view in section showing a state where a sheet guided by a roller member of the separating mechanism shown in FIG. 9.

As shown in FIGS. 9 and 10, the column 610*d* rotatably holds the roller member 80A fitted in a hollow portion 731 of the separating claw 70A to be described later. This column 610*d* is inserted through a column insertion hole 732 of the separating claw 70A in such a manner as not to touch the separating claw 70A fixedly held on the holding portion 610*j* of the projection 610*c* as shown in FIG. 12, and is engaged with the second engaging hole 620*g* of the second holder 62A at a leading end position thereof. By this construction, heat transfer from the separating claw 70A held in contact with the fixing roller 30 for a long time to the roller member 80A via the column 610*d* of the holder member 60A can be suppressed.

As shown in FIG. 9, the shaft inserting portions 610*e*, 620*e* are so arranged as to be adjacent to each other when the respective holders 61A, 62A are assembled, and the supporting shaft 510 for rotatably supporting the holding member 60A is inserted thereinto. A hook 610*k* used to mount one end of the tension coil spring 52 (see FIG. 2) described in the first embodiment is integrally formed at an upper part of the shaft inserting portion 610*e*.

Such a holder member 60A is preferably made of a heat resistant resin having a good heat resistance such as a polyether ketone (PEK), a polyimide (PI) or a polyphenylene sulfide (PPS).

As shown in FIGS. 9 to 11, the separating claw 70A is for separating the sheet P from the fixing roller 30, and has an acute-angled tip portion 710 (see FIG. 11) which comes into contact with the outer circumferential surface of the fixing roller 30, and a trunk portion 730 extending downstream from the tip portion 710 along the conveyance path. The tip portion 710 has a specified width in the rotational axis direction of the fixing roller 30. The trunk portion 730 has a width substantially equal to that of the tip portion 710, and is comprised of an opening 720 (see FIG. 10) which has a rectangular front view and into which the projection 610*c* of the holder member 60A is pressed, the hollow portion 731 having such a size capable of accommodating the roller member 80A, and the column insertion hole 732 into which the column 610*d* of the holder member 60A is inserted.

The hollow portion 731 vertically penetrates the trunk portion 730 near a middle position with respect to the rotational axis direction of the fixing roller 30 so as to be located within an extension area R (see FIG. 9) extending downstream from the tip portion 710 along the conveyance path while having the width of the tip portion 710. The column insertion hole 732 extends through the hollow portion 731 as shown in FIG. 12, so that the column 610*d* crosses the hollow portion 731. Further, the column insertion hole 732 has an inner diameter larger than the outer diameter of the column 610*d*, whereby the column 610*d* inserted thereinto is not in contact therewith.

As described above, the separating claw 70A is so arranged as to be located at a substantially middle position between the side plates 610*a* and 620*a* of the respective holders 61A and 62A and to cause the tip portion 710 to project outward (toward the outer circumferential surface of the fixing roller 30) from an upstream end (right side in the drawing) of the holder member 60A with respect to the conveyance path. Further, the tip portion 710 is held in contact with the outer circumferential surface of the fixing roller 30 by a tensile force of the tension coil spring 52 at a position at a specified distance from a downstream end (hereinafter, referred to as a "nip area exit") of the nip area N with respect to a conveyance direction.

It is preferable that at least the outer surface of such a separating claw 70A is made of a fluoroplastic having a higher heat resistance than the material of the holder member 60A. For example, if the holder member 60A is made of a polyphenylene sulfide (PPS), the outer surface of the separating claw 70A is preferably coated with a tetrafluoroethylene-perfluoroalkoxyethylene copolymer (PFA).

The roller member 80A is so constructed as to come into contact with the sheet P separated from the fixing roller 30 and to guide the sheet P to the downstream side along the conveyance path while being rotated. As shown in FIG. 10, the roller member 80A is rotatably held in the holder 60A while a part of the outer circumferential surface thereof projects from the bottom end of the holder 60A toward the conveyance path located outside (see FIG. 11) by having the column 610*d* inserted through a shaft hole 811 while being fitted in the hollow portion 731 of the separating claw 70A.

The roller member 80A in the hollow portion 731 is held on the column 610*d* with a specified play defined to the separating claw 70A in a projecting direction of the column 610*d* so as to be movable away from the separating claw 70A as shown in FIG. 12. The thus constructed roller member 80A of this embodiment is located within the extension area R (see FIG. 9) downstream of the tip portion 710 along the conveyance path, so as to be arranged between the sheet P separated from the fixing roller 30 by the tip portion 710 and the separating claw 70A.

The outer surface of such a roller member 80A is coated with a fluoroplastic such as a tetrafluoroethylene-perfluoroalkoxyethylene copolymer (PFA) or tetrafluoroethylene resin (PTFE) and have a good heat resistance and a lower friction coefficient with the sheet P. Thus, it is possible to considerably reduce physical loads given to the image on the sheet P when the roller member 80A guides the sheet P to the downstream side along the conveyance path while being rotated. It should be noted that the roller member 80A may be entirely made of the above fluoroplastic.

Figure 13:
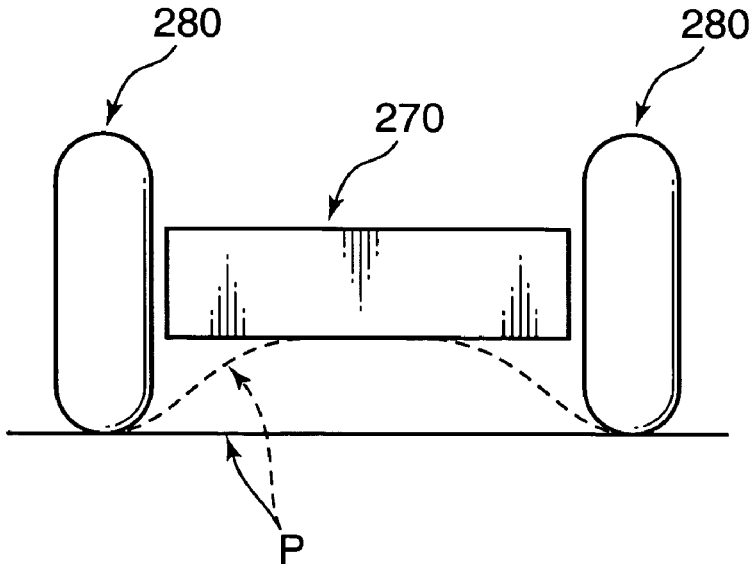
FIG. 13 is a schematic view showing a state of a sheet guided by a roller member of the separating mechanism according to the first embodiment.

By employing the construction of the separating mechanism 50A according to the second embodiment described above, the following advantages can be expected in addition to those given by the separating mechanism 50 according to the first embodiment described before. If a pair of roller members 280 are provided at the opposite sides of a separating claw 270 as shown in FIG. 13, a sheet P separated from a fixing roller by the tip of the separating claw 270 is conveyed while facing the separating claw 270. Thus, if a force acts to displace the sheet P in a direction toward the separating claw 270, for example, when the sheet P separated from the fixing roller is corrugated or pulled back, there is a possibility of bringing an image surface of the sheet P (see dotted line in FIG. 13) into contact with the separating claw 270 depending on the width of the separating claw 270 and the diameter of the roller members 280. This may result in a possibility that the sheet P is scratched by the separating claw 270 to reduce the image quality.

Accordingly, in the separating mechanism 50A of the second embodiment, the roller member 80A is located within the extension area R extending downstream from the tip portion 710 of the separating claw 70A along the conveyance path while having the width of the tip portion 710, thereby enabling the roller member 80A to be arranged between the sheet P separated from the fixing roller 30 by the tip portion 710 and the separating claw 70A. Thus, even if a force acts to displace the sheet P in a direction toward the separating claw 70A, for example, when the sheet P separated from the fixing roller 30 is corrugated or pulled back, the sheet P becomes more unlikely to come into contact with the separating claw 70A. Since an occurrence of a problem of scratching the sheet P by the contact of the sheet P separated from the fixing roller 30 with the separating claw 70A again can be prevented, the reduction in the image quality can be sufficiently suppressed.

Further, the roller member 80A is supported on the column 610*d* while being fitted in the hollow portion 731 formed in the trunk portion 730 having the width substantially equal to that of the tip portion 710. Thus, the hollow portion 731 is located within the extension area R extending downstream from the tip portion 710 along the conveyance path while having the width of the tip portion 710, therefore the roller member 80A can be easily located within the extension area R.

Furthermore, the hollow portion 731 is formed near the middle position of the trunk portion 730 with respect to the rotational axis direction of the fixing roller 30. Since this enables the roller member 80A to be arranged near the middle position of the separating claw 70A with respect to the rotational axis direction of the fixing roller 30, the sheet P becomes even more unlikely to come into contact with the separating claw 70A even if a force acts on the sheet P to displace the sheet P in a direction toward the separating claw 70A.

In this embodiment, the roller member 80A is held on the column 610*d* with the specified play defined to the separating claw 70A in the extending direction of the column 610*d* so as to be movable away from the separating claw 70A. Thus, the roller member 80A suitably comes into contact with the separating claw 70A in the extending direction of the column 610*d* while intermittently coming out of contact with the separating claw 70A. Accordingly, an excessive temperature increase of the roller member 80A can be suppressed while the roller member 80A is prevented from coming off the column 610*d*. Therefore, the influence of the roller member 80 on the image on the sheet P can be reduced while hindering an increase in the number of parts.

Similar to the first embodiment, there are an effect of hindering the sheet P from being scratched by successively switching the members for guiding the leading end of the sheet P from the separating claws 70A of the separating mechanisms 50A, to the guiding portions 610*f*, 620*f* of the holder members 60 and to the roller members 80A toward the downstream side along the conveyance path and an effect of suppressing the remelting of the toner on the sheet P by constructing the holder members 60A and the separating claws 70A by separate members.

Third Embodiment

Next, a separating mechanism according to a third embodiment of the present invention is described. In the third embodiment, a claw member is so supported as to be freely movable in directions about two axes, and the claw member is biased toward the outer circumferential surface of a fixing roller so that a tip portion of the claw member presses the fixing roller. Here, as examples of the above "directions about two axes", the claw member is so supported as to pivot in a first direction about an axis substantially parallel to the central axis of the fixing roller and in a second direction about an axis substantially normal to the central axis of the fixing roller.

Figure 14:
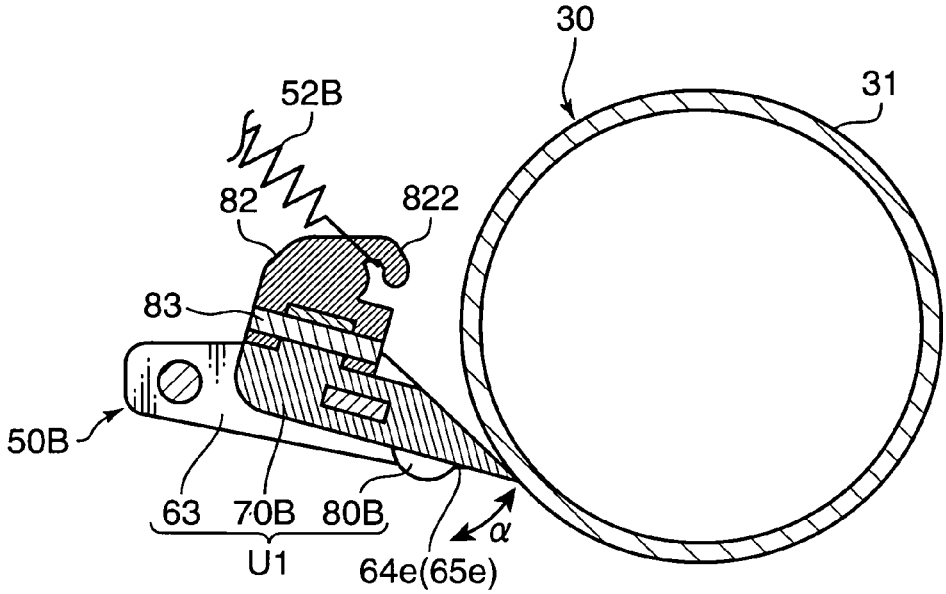
FIG. 14 is a section showing a separating mechanism and a fixing roller according to a third embodiment of the invention.
Figure 15:
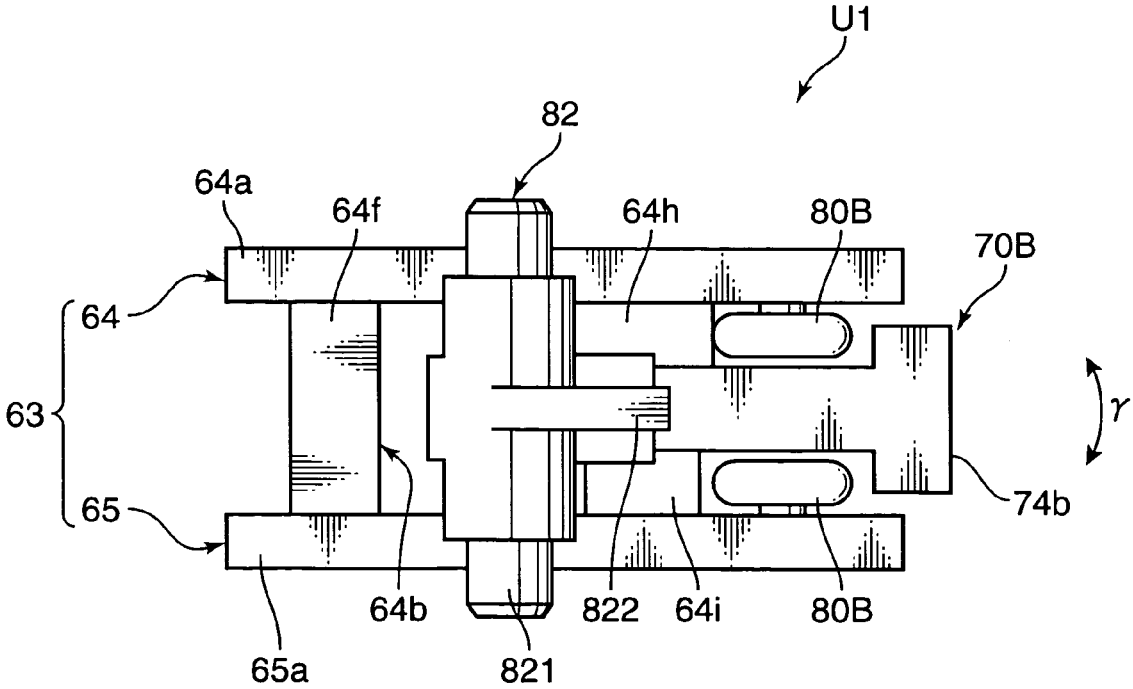
FIG. 15 is a plan view showing the construction of the separating mechanism according to the third embodiment.
Figure 16:
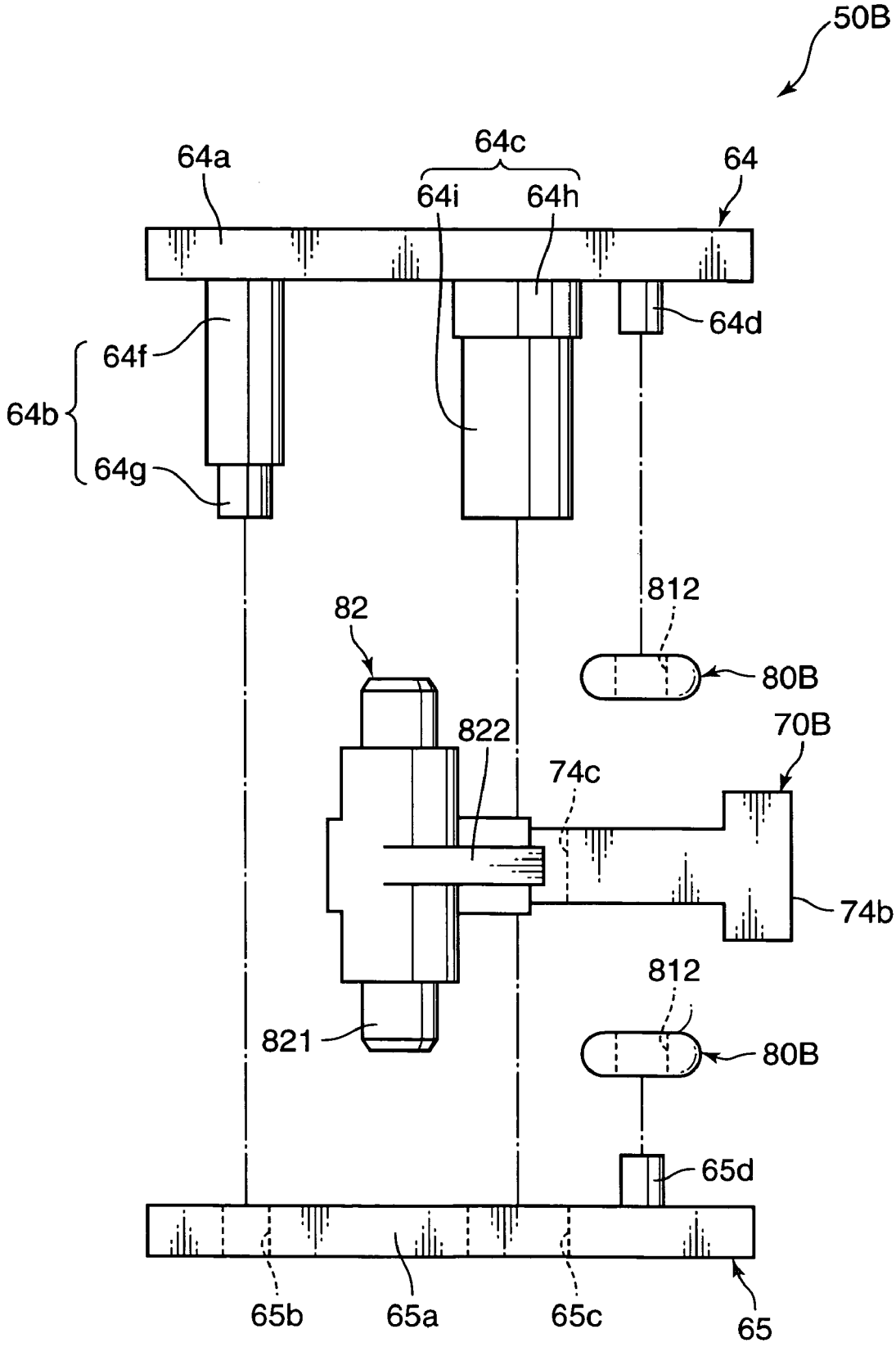
FIG. 16 is a plan view showing an exploded state of the separating mechanism shown in FIG. 15.
Figure 17:
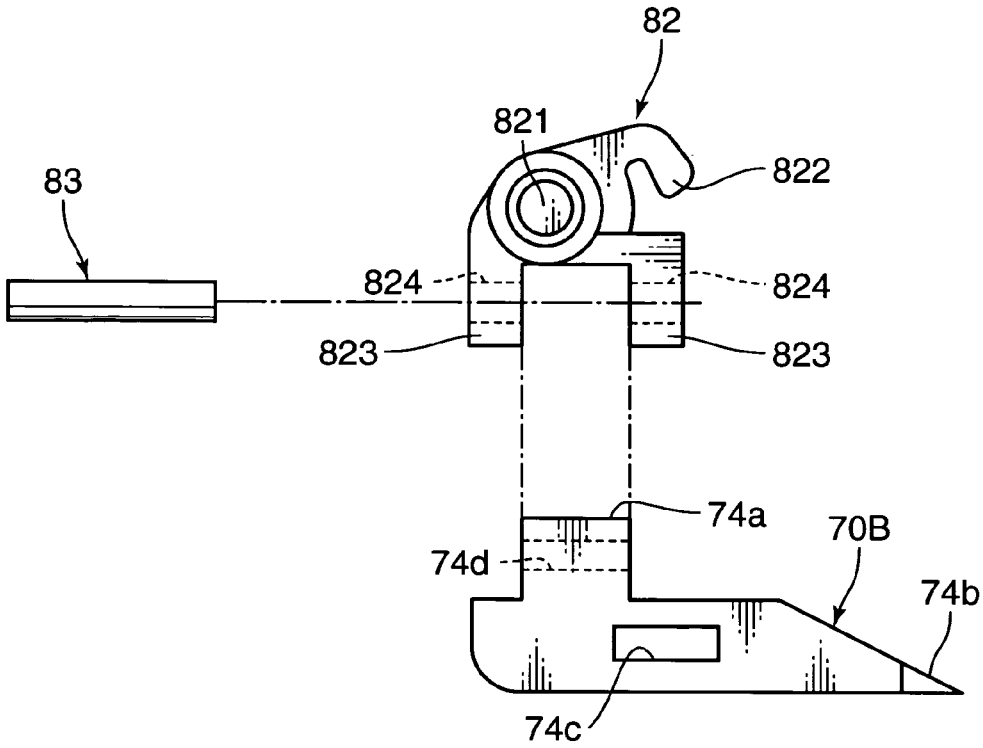
FIG. 17 is an exploded front view showing a structure for coupling a claw member of a separating claw unit and a supporting member shown in FIG. 15.
Figure 18:
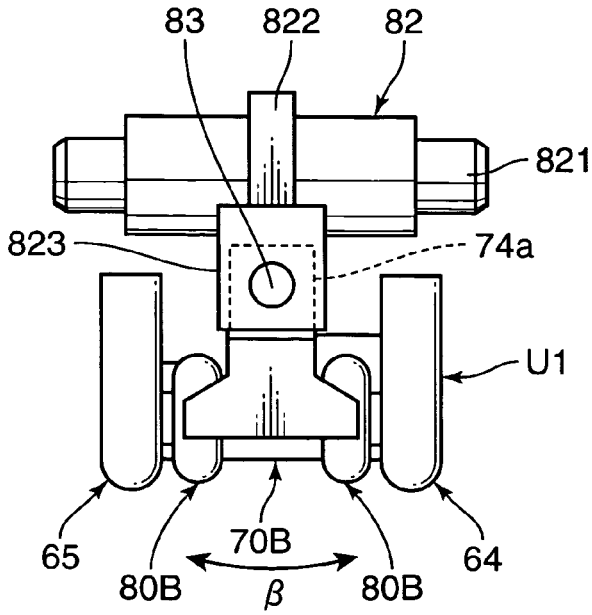
FIG. 18 is a right side view showing the separating claw unit and the supporting member shown in FIG. 15.

FIG. 14 is a section showing a separating mechanism 50B according to the third embodiment of the present invention and a fixing roller 30, FIG. 15 is a plan view showing the construction of the separating mechanism 50B, FIG. 16 is a plan view showing an exploded state of the separating mechanism 50B, FIG. 17 is an exploded front view showing a structure for coupling a claw member of a separating claw unit U1 and a supporting member 82, and FIG. 18 is a right side view of the separating claw unit U1 and the supporting member 82.

As shown in FIG. 14, the separating mechanism 50B according to the third embodiment is provided with the separating claw unit U1, the supporting member 82, a tension coil spring 52B (biasing member), and a coupling pin 83. The separating claw unit U1 has a function of separating a sheet P from the fixing roller 30, and includes a holder member 63, a separating claw 70B and a pair of roller members 80B.

The holder member 63 is so arranged as not to touch the fixing roller 30 and shaped to fixedly hold the separating claw 70B while embracing the separating claw 70B and the roller members 80B. This holder member 63 includes a male holder 64 having a male structure and a female holder 65 having a female structure as shown in FIG. 16.

The male holder 64 includes a side plate 64*a*; a holder width defining portion 64*b*, a claw fixing portion 64*c* and a supporting shaft portion 64*d* formed on a surface of the side plate 64*a* facing the female holder 65; and a guiding portion 64*e* (see FIG. 14) provided at a bottom part of an upstream side of the side plate 64*a* with respect to a conveyance path.

Further, the female holder 65 includes a side plate 65*a*; an insertion hole 65*b* and a press-in hole 65*c* formed at positions of the side plate 65*a* corresponding to the holder width defining portion 64*b* and the claw fixing portion 64*c* of the male holder 64; a supporting shaft portion 65*d* formed on a surface of the side plate 65*a* facing the male holder 64; and a guiding portion 65*e* (see FIG. 14) provided at a bottom part of an upstream side of the side plate 65*a* with respect to the conveyance path.

The holder width defining portion 64*b* is provided to define the width (vertical dimension in the plane of FIG. 15) of the holder member 63 by defining an interval between the respective holders 64, 65. This holder width defining portion 64*b* is comprised of a cylindrical base portion 64*f*, and an inserting portion 64*g* insertable into the insertion hole 65*b* of the female holder 65 and having a diameter smaller than the base portion 64*f*. By the contact of the base portion 64*f* of the holder width defining portion 64*b* with the side plate 65*a* of the female holder 65, the side plates 64*a*, 65*a* are opposed to each other while being spaced part by a distance equal to the longitudinal length of the base portion 64*f*.

The claw fixing portion 64*c* is provided to fixedly hold the separating claw 70B between the respective holders 64 and 65. This claw fixing portion 64*c* extends in such a direction as to bridge the side plates 64*a*, 65*a* arranged in parallel, and is comprised of a base portion 64*h* having a rectangular cross section and a press-in portion 64*i* having a cross section one size smaller than that of the base portion 64*h*. The press-in portion 64*i* is pressed successively into an opening 74*c* of the separating claw 70B to be described later and the press-in hole 65*c* of the female holder 65. The contact of the base portion 64*h* of the claw fixing portion 64*c* with the side surface of the separating claw 70B restrains the separating claw 70B from moving toward the side plate 64*a* of the male holder 64 greater than a specified distance. The separating claw 70B held on the press-in portion 64*i* pressed into the opening 74*c* while having the position thereof defined by the base portion 64*h* of the claw fixing portion 64*c* is located at a substantially middle position between the side plates 64*a* and 65*a* as shown in FIG. 15.

The supporting shaft portions 64*d*, 65*d* are arranged to face each other at the opposite sides of the separating claw 70B, and rotatably hold the roller members 80B thereon. These supporting shaft portions 64*d*, 65*d* project from the corresponding side plates 64*a*, 65*a* by such amounts as not to touch the separating claw 70B. The guiding portions 64*e*, 65*e* are provided to smoothly guide the leading end of the sheet P to the roller members 80B on the sheet conveyance path between the separating claw 70B and the roller members 80B.

As shown in FIG. 17, the separating claw 70B includes a coupling portion 74*a* in the form of a projection formed at a top part of the separating claw 70B, an end claw portion 74*b* (tip portion of the claw member) in the form of a flat plate formed at the right end of the separating claw 70B, and the opening 74*c* having a rectangular front view and formed at a substantially middle position of the separating claw 70B.

The coupling portion 74*a* is formed with a pin press-in hole 74*d* transversely penetrating the coupling portion 74*a* in FIG. 17. The separating claw 70B is coupled to the supporting member 82 via the coupling pin 83 pressed into this pin press-in hole 74*d*.

The end claw portion 74*b* is formed to have an acute-angled tip in vertical section, and projects outward from an upstream end of the holder member 63 with respect to the sheet conveyance path in an assembled state of the separating claw unit U1. Further, the end claw portion 74*b* is in contact with the outer circumferential surface of the fixing roller 30 by a biasing force of the tension coil spring 52B at a position at a specified distance from a downstream end (nip area exit) of a nip area with respect to a conveyance direction with the separating mechanism 50B mounted in a housing 21 (see FIG. 2).

As described above, the opening 74*c* is for fixedly holding the separating claw 70B in the holder member 63 by having the press-in portion 64*i* of the claw fixing portion 64*c* thereinto.

A pair of roller members 80B are rotatably held in the holder member 63 by having the supporting shaft portions 64*d*, 65*d* inserted into shaft holes 812 thereof, and are arranged at the opposite sides of the separating claw 70B between the side plates 64*a*, 65*a*. As shown in FIG. 15, the roller members 80B are held on the corresponding supporting shaft portions 64*d*, 65*d* with specified plays defined to the separating claw 70B in projecting directions of the supporting shaft portions 64*d*, 65*d* so as to be movable away from the separating claw 70B. Further, the roller members 80B are formed such that the outer circumferential surfaces thereof are partially exposed outward from the bottom end of the holder member 63 while being held in the holder member 63.

The supporting member 82 has a function of supporting the separating claw unit U1 pivotably in directions about two axes in order to constantly hold the end claw portion 74*b* of the separating claw 70B of the separating claw unit U1 in close contact with the outer circumferential surface of the fixing roller 30. The supporting member 82 includes a shaft portion 821, a hook portion 822 and a pair of coupling pieces 823.

The shaft portion 821 is mounted at a specified position in the housing 21 with the central axis thereof held substantially in parallel with the central axis of the fixing roller 30. Thus, the supporting member 82 is pivotable in directions (directions α in FIG. 14: corresponding to the "first directions") about an axis substantially in parallel with the central axis of the fixing roller 30.

The hook portion 822 is for mounting one end of the tension coil spring 52B. The coupling pieces 823 are opposed to each other while being transversely spaced apart by a specified distance in FIG. 17, and are formed with pin insertion holes 824 through which the coupling pin 83 is insertable. An interval between these coupling pieces 823 is set to be slightly longer than a transverse length of the coupling portion 74*a* of the separating claw 70B.

In this embodiment, the separating claw unit U1 is coupled to the supporting member 82 via the coupling pin 83 arranged to be substantially normal to the fixing roller 30 by fitting the coupling portion 74*a* of the separating claw 70B between a pair of coupling pieces 823 of the supporting member 82, inserting the coupling pin 83 into the pin insertion hole 824 of the supporting member 82 and pressing the coupling pin 83 into the pin press-in hole 74*d* of the separating claw 70B. In this coupled state, the separating claw unit U1 is pivotable in directions (directions β in FIG. 18: corresponding to the "second directions") about the axis substantially normal to the central axis of the fixing roller 30.

The tension coil spring 52B is similar to the tension coil spring 52 shown in FIG. 2, and the other end thereof is attached to an engaging portion 21*a* formed in the housing 21 of the image fixing unit 14. In this way, the end claw portion 74*b* of the separating claw 70B is biased in a counterclockwise direction in FIG. 17 about the shaft portion 821 so as to come into contact with the outer circumferential surface of the fixing roller 30.

In the separating mechanism 50B constructed as above, the end claw portion 74*b* of the separating claw 70B is in contact with the outer circumferential surface of the fixing roller 30 by a biasing force of the tension coil spring 52B, the separating claw unit U1 pivots in the directions β in FIG. 18 about the coupling pin 83 relative to the supporting member 82, and the supporting member 82 pivots, together with the separating claw unit U1, in the directions α in FIG. 14 about the shaft portion 821 relative to the housing 21.

As described above, the separating claw unit U1 biased toward the fixing roller 30 is free to move in the directions about the two axes in the separating mechanism 50B of the third embodiment. By employing such a construction, even if only one side of the separating claw unit U1 is held in contact with the outer circumferential surface of the fixing roller 30, for example, due to the dimensional tolerance or the like of the components, the separating claw unit U1 can quickly pivot in such a direction as to correct the posture of the separating claw unit U1 while yielding to the biasing force of the tension coil spring 52B, therefore the separating claw unit U1 can be constantly held in contact (close contact) with the outer circumferential surface of the fixing roller 30 at a uniform pressure. Since this can increase the contact area of the separating claw unit U1 with the outer circumferential surface of the fixing roller 30, the contact pressure per unit area of the separating claw unit U1 with the fixing roller 30 can be reduced. Thus, the abrasion of the outer circumferential surface of the fixing roller 30 caused by the contact with the separating claw unit U1 can be sufficiently suppressed, therefore the occurrence of image deterioration can be sufficiently suppressed.

Further, since the separating claw unit U1 can quickly pivot in the direction about the coupling pin 83 substantially normal to the central axis of the fixing roller 30 to securely correct the posture of the separating claw unit U1 if only one side of the separating claw unit U1 is held in contact with the fixing roller 30, the separating claw unit U1 can be securely held in close contact with the outer circumferential surface of the fixing roller 30.

Furthermore, the supporting member 82 can be caused to pivot in the direction about the shaft portion 821 parallel to the central axis of the fixing roller 30 relative to the housing 21 while the separating claw unit U1 is caused to pivot in the direction about the coupling pin 83 substantially normal to the central axis of the fixing roller 30 relative to the supporting member 82. Therefore, the separating claw unit U1 can be easily freely moved in the directions about two different axes without using a complicated mechanism.

In this embodiment, the separating claw unit U1 is caused to pivot in the directions about the two different axes by causing the supporting member 82 to pivot in the directions α about the shaft portion 821 relative to the housing 21 and causing the separating claw unit U1 to pivot in the directions β about the coupling pin 83 relative to the supporting member 82. In addition, a coupling mechanism including a coupling pin may be provided, for example, between the supporting member 82 and the separating claw unit U1 to cause the separating claw unit U1 to pivot also in directions γ in addition to the directions β relative to the supporting member 82, so that the separating claw unit U1 may be caused to pivot in directions about three different axes. It should be noted that the directions γ are, for example, those about an axis normal to both the shaft portion 821 and the coupling pin 83 (normal to the plane of FIG. 15).

Fourth Embodiment

Next, a separating mechanism according to a fourth embodiment of the present invention is described. In the fourth embodiment, a claw member is so supported as to be freely movable in directions about many axes and is biased toward the outer circumferential surface of a fixing roller such that the tip portion of the claw member presses the fixing roller. Here, a claw member having a pivotal supporting portion that is provided at a position at a specified distance from the tip portion of the claw member held in contact with the outer circumferential surface of the fixing roller and functions as a supporting point in a pivoting state is shown as an example of the claw member supported freely movable in the "directions about many axes".

Figure 19:
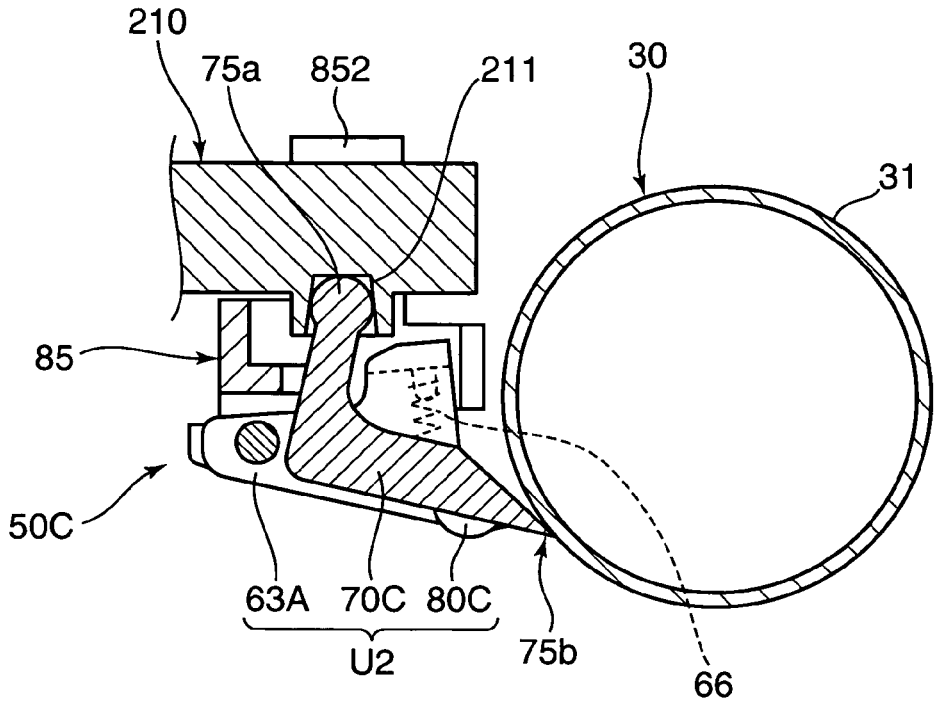
FIG. 19 is a section showing a separating mechanism and a fixing roller according to a fourth embodiment of the invention.
Figure 20:
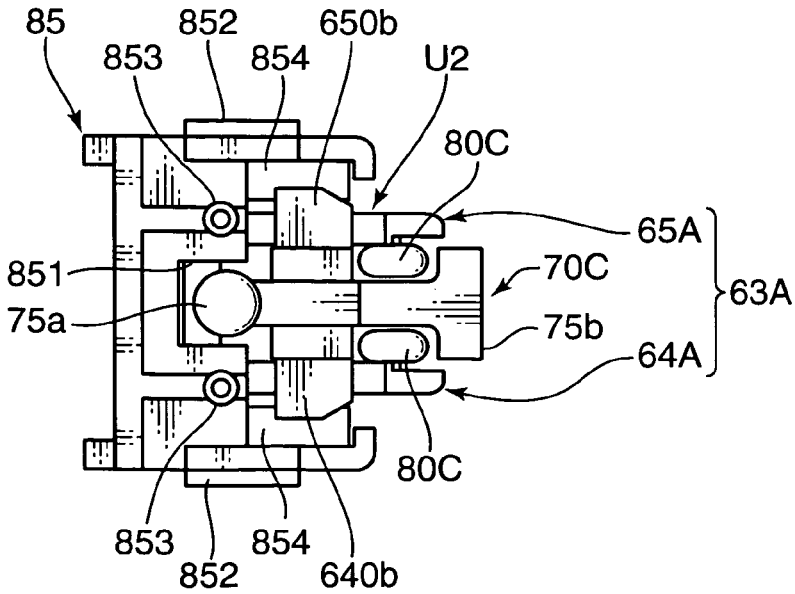
FIG. 20 is a plan view showing the construction of the separating mechanism according to the fourth embodiment.
Figure 21A:
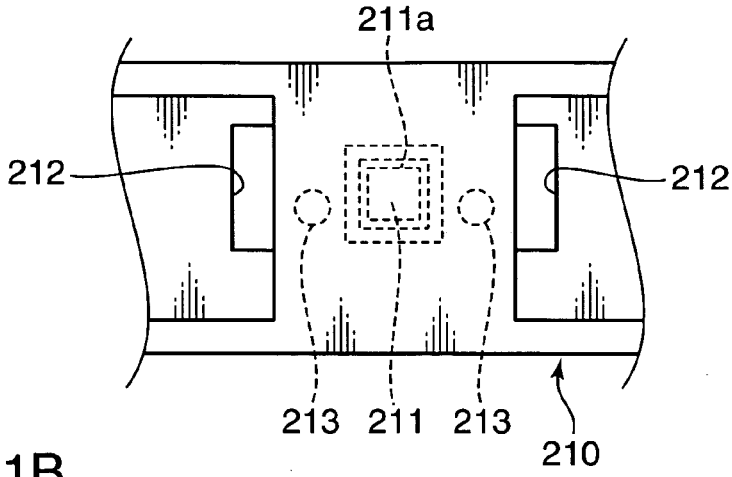
Figure 21B:
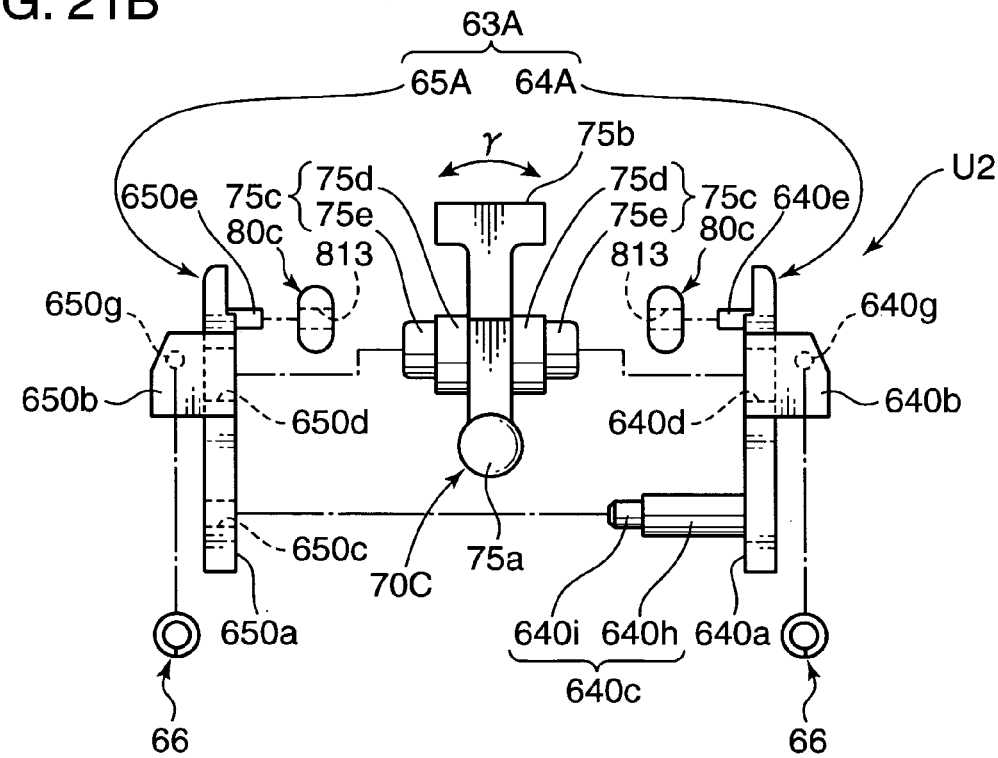
Figure 21C:
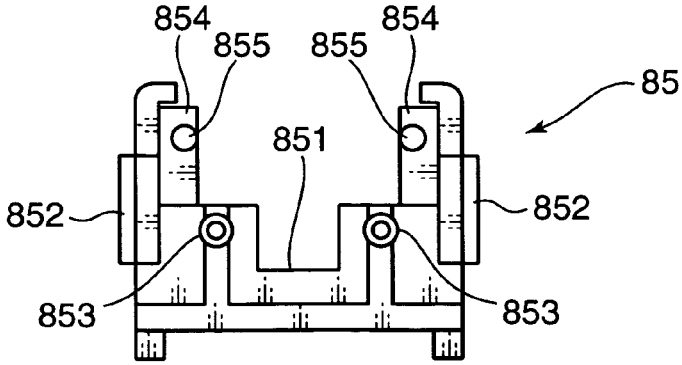
Figure 22A:
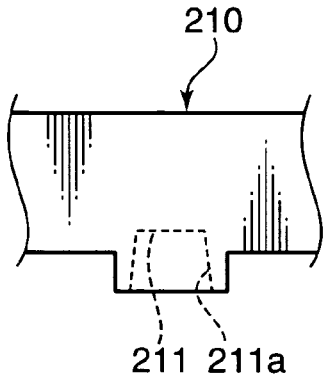
Figure 22B:
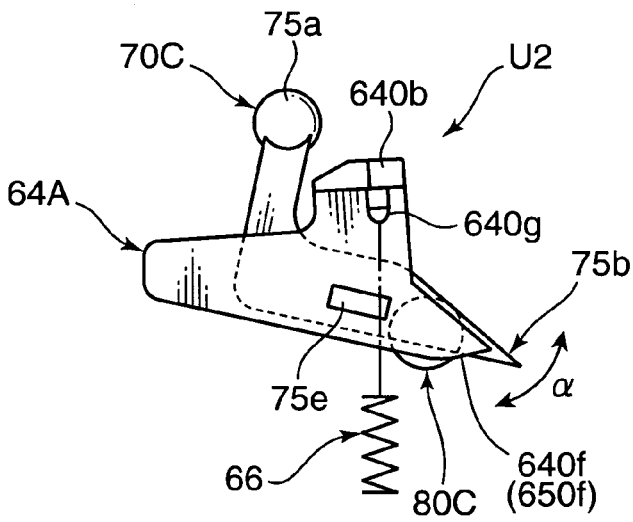
Figure 22C:
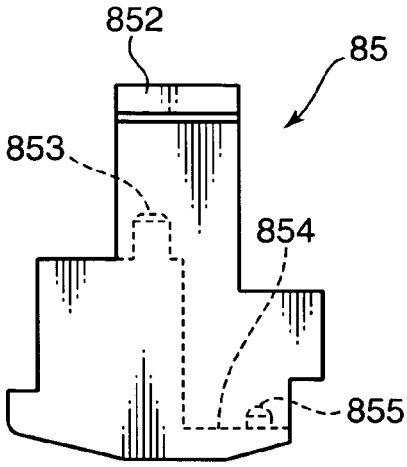
Figure 23A:
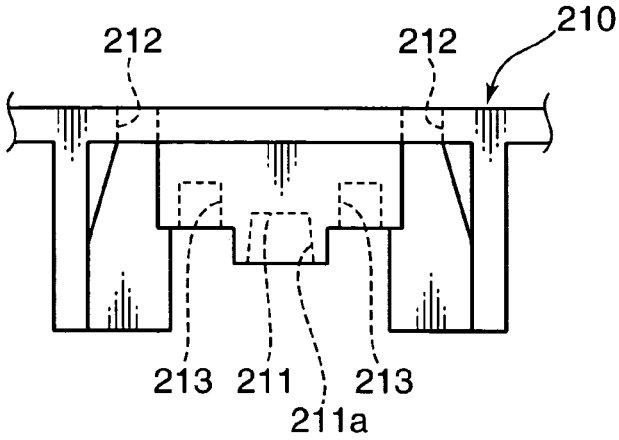
Figure 23B:
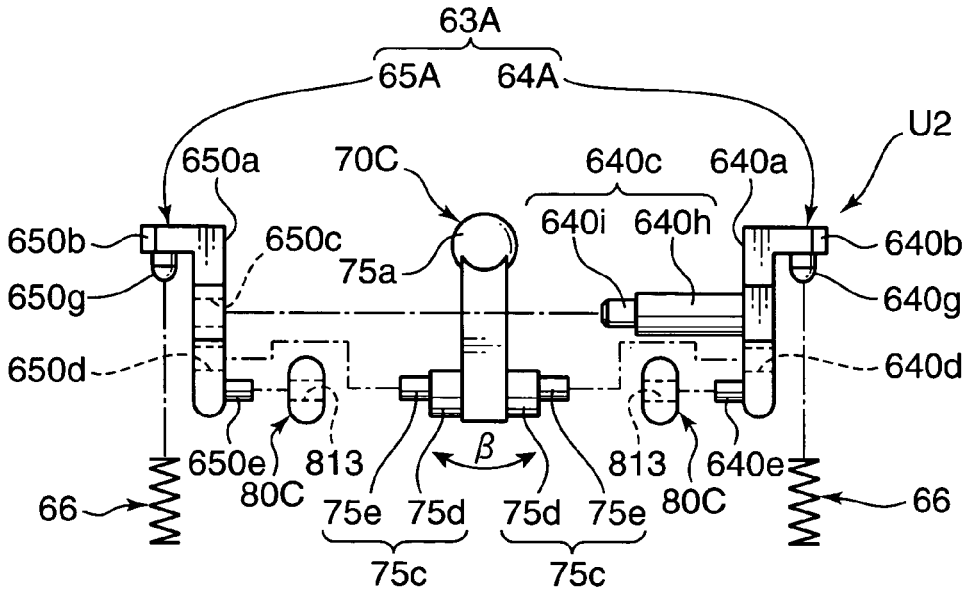
Figure 23C:
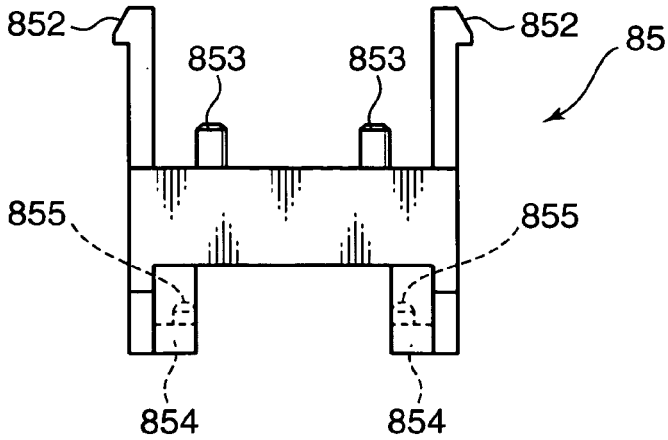

FIG. 19 is a section showing a separating mechanism 50C according to the fourth embodiment of the present invention and a fixing roller 30, FIG. 20 is a plan view showing the construction of the separating mechanism 50C, FIGS. 21A to 21C are plan views showing an exploded state of the separating mechanism 50C, FIGS. 22A to 22C are front views showing the exploded state of the separating mechanism 50C, and FIGS. 23A to 23C are side views showing the exploded state of the separating mechanism 50*c* according to the fourth embodiment.

As shown in FIG. 19, the separating mechanism 50C according to the fourth embodiment is provided with a separating claw unit U2, a supporting member 85 and a pair of compression coil springs 66. The separating claw unit U2 has a function of separating a sheet P from the fixing roller 30 and includes a holder member 63A, a separating claw 70C substantially L-shaped in front view, and a pair of roller members 80C.

The holder member 63A is so arranged as to fixedly hold the separating claw 70C and not to touch the fixing roller 30 and shaped to embrace the separating claw 70C and the roller members 80C. This holder member 63A includes a male holder 64A having a male structure and a female holder 65A having a female structure.

As shown in FIGS. 21B, 22B, 23B, the male holder 64A includes a side plate 640*a* having a laterally long front view; a spring seat 640*b* formed at an upper part of the side plate 640*a*; a holder width defining portion 640*c* formed on a surface of the side plate 640*a* facing the female holder 65A; a press-in hole 640*d* formed at a position of the side plate 640*a* corresponding to one movement preventing portion 75*c* of the separating claw 70C to be described later; a supporting shaft portion 640*e* formed on the surface of the side plate 640*a* facing the female holder 65A; and a guiding portion 640*f* (see FIG. 22B) provided at a bottom part of an upstream side of the side plate 640*a* with respect to a conveyance path.

Further, the female holder 65A includes a side plate 650*a* having a laterally long front view; a spring seat 650*b* formed at an upper part of the side plate 650*a*; an insertion hole 650*c* formed at a position of the side plate 650*a* corresponding to the holder width defining portion 640*c* of the male holder 64A; a press-in hole 650*d* formed at a position of the side plate 650*a* corresponding to the other movement preventing portion 75*c* of the separating claw 70C; a supporting shaft portion 650*e* formed on a surface of the side plate 650*a* facing the male holder 64A; and a guiding portion 650*f* (see FIG. 22B) provided at a bottom part of an upstream side of the side plate 650*a* with respect to the conveyance path.

The upper ends of the compression coil springs 66 are brought into contact with the spring seats 640*b*, 650*b*, and bosses 640*g*, 650*g* engageable with the upper ends of the compression coil springs 66 are formed on the lower surfaces of the spring seats 640*b*, 650*b*. These spring seats 640*b*, 650*b* are located substantially in the middle between the pivotal supporting portion 75*a* of the separating claw 70C to be described later and an end claw portion 75*b* when the separating claw unit U2 is assembled.

The holder width defining portion 640*c* is provided to define the width of the holder member 63A by defining an interval between the respective holders 64A and 65A. This holder width defining portion 640*c* is comprised of a cylindrical base portion 640*h*, and an inserting portion 640*i* insertable into the insertion hole 650*c* of the female holder 65A and having a diameter smaller than the base portion 640*h*. By the contact of the base portion 640*h* of the holder width defining portion 640*c* with the side plate 650*a* of the female holder 65A, the side plates 640*a*, 650*a* are held spaced apart by a distance equal to the longitudinal length of the base portion 640*h*.

The supporting shaft portions 640*e*, 650*e* are arranged to face each other, and rotatably hold the roller members 80C thereon. These supporting shaft portions 640*e*, 650*e* project from the corresponding side plates 64*a*, 65*a* by such amounts as not to touch the separating claw 70C.

The guiding portions 640*f*, 650*f* are provided to smoothly guide the leading end of a sheet P to the roller members 80C on the conveyance path for the sheet P between the end claw portion 75*b* of the separating claw 70C and the roller members 80C.

The separating claw 70C is held in contact with the outer circumferential surface of the fixing roller 30 and includes the pivotal supporting portion 75*a*, the end claw portion 75*b* (tip portion of the claw member) and a pair of movement preventing portions 75*c*.

The pivotal supporting portion 75*a* has a substantially spherical shape, and is so held in a recess-shaped pivot receiving portion 211 (see FIGS. 21A, 22A and 23A) formed in a housing 210 (corresponding to the housing 21 shown in FIG. 2) as to make pivoting movements when the separating mechanism 50C is mounted in the housing 210.

The pivot receiving portion 211 has a substantially square horizontal section and is gradually widened from the bottom thereof toward the opening thereof. The pivotal supporting portion 75*a* functions as a supporting point when the end claw portion 75*b* of the separating claw unit U2 freely moves in directions about many axes (pivoting movements about many axial directions: see arrows $\gamma$, $\alpha$, $\beta$ in FIGS. 21B, 22B, 23B). It should be noted that the pivotal supporting portion 75*a* is formed to have, for example, a conical shape other than the substantially spherical shape.

The end claw portion 75*b* is at a specified distance from the pivotal supporting portion 75*a*, in the form of a flat plate, and formed to have an acute-angled tip in vertical section. This end claw portion 75*b* is held in contact with the outer circumferential surface of the fixing roller 30 in such a state as to be pivotable about many axial directions with the pivotal supporting portion 75*a* as the supporting point by mounting the separating mechanism 50C in the housing 210 as described above.

Each movement preventing portion 75*c* is for fixing the separating claw 70C to the holder member 63A and is comprised of a base portion 75*d* having a rectangular cross section and a press-in portion 75*e* having a cross section one size smaller than that of the base portion 75*d*. The base portions 75*d* are held in contact with the side plates 640*a*, 650*a* of the respective holders 64A, 65A, thereby preventing the separating claw 70C from moving between the respective holders 64A, 65A. The separating claw 70C having the position defined by the base portions 75*d* of the movement preventing portions 75*c* in this way are located at a substantially middle position between the side plates 640*a* and 650*a*.

This separating claw 70C is arranged such that the end claw portion 75*b* projects outward from an upstream end of the holder member 63A with respect to the conveyance path. Further, by biasing forces of the pair of compression coil springs 66, the end claw portion 75*b* is held in contact with the outer circumferential surface of the fixing roller 30 at a position spaced apart by a specified distance from a downstream end of a nip area (nip area exit) with respect to a conveyance direction.

A pair of roller members 80C are rotatably held in the holder member 63A by having the supporting shaft portions 640*e*, 650*e* inserted into shaft holes 831 thereof, and arranged at the opposite sides of the separating claw 70C between the side plates 640*a*, 640*a*. As shown in FIG. 20, the roller members 80C are held on the supporting shaft portions 640*e*, 650*e* with specified plays defined to the separating claw 70C in projecting directions of the supporting shaft portions 640*e*, 650*e* so as to be movable away from the separating claw 70C. Further, the roller members 80C are formed such that the outer circumferential surfaces thereof are partially exposed outward from the bottom end of the holder member 63A while being held in the holder member 63A.

The supporting member 85 has a function of supporting the separating claw unit U2 pivotably about many axial directions in order to constantly hold the separating claw 70C of the separating claw unit U2 in close contact with the outer circumferential surface of the fixing roller 30. The supporting member 85 is comprised of a recessed portion 851, a pair of hook portions 852, a pair of positioning projections 853 and a pair of spring seats 854.

The recessed portion 851 is formed by recessing the supporting member 85 at a specified position to have a rectangular plan view so that the supporting member 85 does not interfere with the separating claw 70C of the separating claw unit U2.

The hook portions 852 are provided to fix the supporting member 85 to the housing 210 by being inserted into and engaged with hook engaging holes 212 formed in the housing 210.

The positioning projections 853 function to position the supporting member 85 by being inserted into positioning recesses 213 formed in the housing 210 when the supporting member 85 is mounted into the housing 210.

The bottom ends of the compression coil springs 66 are brought into contact with the spring seats 854, and bosses 855 engageable with the bottom ends of the compression coil springs 66 are formed on the upper surfaces of the spring seats 854.

The pair of compression coil springs 66 are arranged along the longitudinal axis of the fixing roller 30 (see FIG. 19) at positions symmetrical with respect to the pivotal supporting portion 75*a* (see FIGS. 21B and 23B). The compression coil springs 6 span between the spring seats 854 of the supporting member 85 and the spring seats 640*b*, 650*b* of the separating claw unit U2 and are supported while biasing the separating claw unit U2 toward the outer circumferential surface of the fixing roller 30 so that the separating claw 70C presses the fixing roller 30. This pair of compression coil springs 66 are so compressed as to hold the separating claw unit U2 in contact with both the housing 210 and the outer circumferential surface of the fixing roller 30 by the biasing forces of the compression coil springs 66 when the supporting member 85 is mounted into the housing 210.

In the separating mechanism 50C of the fourth embodiment constructed as above, both ends (upper and lower ends in FIG. 20) of the end claw portion 75*b* of the separating claw 70C of the separating claw unit U2 are held in contact with the outer circumferential surface of the fixing roller 30 substantially with the same pressing forces by the biasing forces of the pair of compression coil springs 66. For example, if only one side of the separating claw unit U2 is in contact with the outer circumferential surface of the fixing roller 30, the separating claw unit U2 pivots about many axial directions (see arrows γ, α, β in FIGS. 21B, 22B, 23B) with the pivotal supporting portion 75*a* held in the conical pivot receiving portion 211 of the housing 210 in such a manner as to make pivoting movements as the supporting point while yielding to the biasing forces of the pair of compression coil springs 66.

As described above, by constructing the separating claw unit U2 to be pivotable about many axial directions, the separating claw unit U2 can quickly pivot in such a direction as to correct the posture thereof while yielding to the biasing forces of the compression coil springs 66 even if only one side of the separating claw unit U2 is in contact with the outer circumferential surface of the fixing roller 30, for example, due to the dimensional tolerance or the like of components. Thus, the separating claw unit U2 can be constantly held in contact (close contact) with the outer circumferential surface of the fixing roller 30 at a uniform pressure. Since this can increase a contact area of the separating claw unit U2 with the outer circumferential surface of the fixing roller 30, a contact pressure per unit area given to the fixing roller 30 by the separating claw unit U2 can be reduced. As a result, the abrasion of the outer circumferential surface of the fixing roller 30 caused by the contact with the separating claw unit U2 can be sufficiently suppressed, therefore an occurrence of image deterioration can be sufficiently suppressed.

By employing such a construction as to support the separating claw unit U2 on the supporting member 85 via the compression coil springs 66, the separating claw unit U2 can be supported by the compression coil springs 66 while being biased toward the fixing roller 30 by the compression coil springs 66. Accordingly, the compression coil springs 66 elongate or contract to absorb an external force acting on the separating claw unit U2, whereby the separating claw unit U2 can easily pivot in conformity with the external force.

In this embodiment, the separating claw 70C is comprised of the pivotal supporting portion 75*a* functioning as the supporting point and the end claw portion 75*b* provided at the specified distance from the pivotal supporting portion 75*a*. Further, parts (spring seats 640*b*, 650*b* of the respective holders 64A, 65A) between the pivotal supporting portion 75*a* and the end claw portion 75*b* of the separating claw 70C are respectively biased by the pair of compression coil springs 66. This enables the end claw portion 75*b* in contact with the outer circumferential surface of the fixing roller 30 to easily pivot with the pivotal supporting portion 75*a* as the supporting point.

Further, the pivotal supporting portion 75*a* of the separating claw 70C can be caused to securely function as the supporting point by being held in contact with the housing 210 by the biasing forces of the compression coil springs 66. Accordingly, the end claw portion 75*b* can be caused to pivot about many axial directions by letting the biasing forces of the compression coil springs 66 act on the end claw portion 75*b* of the separating claw 70C. Further, the substantially spherical pivotal supporting portion 75*a* can easily make pivoting movements by being held in the recess-shaped pivot receiving portion 211 formed in the housing 210. Therefore, the end claw portion 75*b* of the separating claw 70C can be caused to easily pivot about many axial directions.

In this embodiment, the pivot receiving portion 211 is formed to have a substantially square horizontal section and to be gradually widened from the bottom thereof toward the opening thereof. In this way, the pivot receiving portion 211 comes to possess a surrounding wall 211*a* inclined to be gradually widened from the bottom toward the opening, therefore such a force as to constantly locate the substantially spherical pivotal supporting portion 75*a* at a specified position (see FIG. 19) substantially in the center of the pivot receiving portion 211 can be let to act on the pivotal supporting portion 75*a*. Hence, the pivotal supporting portion 75*a* can be caused to stably make rotary movements (pivoting movements) since the pivotal supporting portion 75*a* can be rotatably held at the specified position.

Further in this embodiment, the pair of compression coil springs 66 is arranged at the positions symmetrical with respect to the pivotal supporting portion 75*a* and along the longitudinal direction of the fixing roller 30. Thus, two independent biasing forces can be exerted in a well-balanced manner to the separating claw unit U2 by the pair of compression coil springs 66 in order to hold both ends of the end claw portion 75*b*, which is freely movable in many directions with the pivotal supporting portion 75*a* as the supporting point, with the outer circumferential surface of the fixing roller 30. Accordingly, even if the above biasing forces are weak, there is no likelihood that only one side of the separating claw 70C of the separating claw unit U2 is held in contact with the outer circumferential surface of the fixing roller 30. Therefore, the separating claw unit U2 having the end claw portion 75*b* in the form of a relatively wide flat plate can be held in close contact with the outer circumferential surface of the fixing roller 30 with weak pressing forces.

In this embodiment, the supporting member 85 in which the separating claw unit U2 is pivotably supported is separately provided and mounted in the housing 210. Instead, the separating claw unit U2 may be supported by a supporting portion integrally formed in the housing 210.

Further, in this embodiment, the pivot receiving portion 211 is formed to have a substantially square horizontal section and to be gradually widened from the bottom thereof toward the opening thereof. However, the present invention is not limited thereto, and the pivot receiving portion 211 may be formed to have a polygonal horizontal section other than the square one and to be gradually widened from the bottom thereof toward the opening thereof or may be formed to have a conical shape or a semispherical shape having an inner diameter slightly larger than the outer diameter of the substantially spherical pivotal supporting portion 75*a*.

Furthermore, in this embodiment, the pair of compression coil springs 66 are mounted to span between the spring seats 854 of the supporting member 85 and the spring seats 640*b*, 650*b* of the separating claw unit U2, thereby biasing a part of the separating claw unit U2 closer to the fixing roller 30 than the pivotal supporting portion 75*a* by the pair of compression coil springs 66. However, the present invention is not limited thereto, and the part of the separating claw unit U2 closer to the fixing roller 30 than the pivotal supporting portion 75*a* may be so biased as to be pulled up, for example, by a pair of tension coil springs attached to the housing 210 at one side. Alternatively, the separating claw unit U2 may be supported by a supporting mechanism and the part thereof closer to the fixing roller 30 than the pivotal supporting portion 75*a* may be so biased as to be pushed down by a pair of compression coil springs.

It should be noted that the first to fourth embodiments disclosed in this specification are illustrative, but not restrictive in all aspects. The scope of the present invention is defined by the appended claims rather than by the preceding description, and all changes that fall within metes and bounds of the claims, or equivalence of such metes and bounds are embraced by the claims.

For example, although the inventive fixing device is applied to the image fixing unit 14 provided in the printer 10 in the foregoing embodiments, the present invention is not limited thereto and is also applicable to image fixing units provided in other image forming apparatuses such as copiers and facsimile machines.

The aforementioned specific embodiments mainly embrace features of the inventions having the following constructions.

A fixing device according to one aspect of the present invention comprises a fixing roller for fixing a toner image transferred onto a sheet and conveying the sheet along a specified conveyance path, and a separating mechanism for separating the sheet from the fixing roller, the separating mechanism including a claw member having a tip portion held in contact with the outer circumferential surface of the fixing roller for separating the sheet from the fixing roller, a holder member for holding the claw member and a rotary member rotatably held in the holder member at a position downstream of the tip portion of the claw member with respect to the conveyance path and adapted to guide the sheet separated from the fixing roller to a downstream side along the conveyance path while being rotated, the holder member having a guiding portion for guiding the sheet to the rotary member on the conveyance path between the tip portion and the claw member and the rotary member.

According to this fixing device, the sheet separated from the fixing roller can be actively guided to the rotary member by the guiding portion by providing the guiding portion for guiding the sheet to the rotary member on the conveyance path between the tip portion of the claw member and the rotary member. Thus, even if the claw member and the rotary member are arranged in such a positional relationship as to largely change a conveyance direction (path) of the separated sheet, the members for guiding the sheet are smoothly switched from the claw member to the rotary member by way of the guiding portion, whereby the sheet can be smoothly brought into contact with the outer circumferential surface of the rotary member while it is suppressed to largely change the sheet conveyance direction. Further, since the guiding member can be switched from the claw member to the guiding portion of the holder member provided separately from the claw member and the sheet separated from the fixing roller can be guided by the guiding portion to a downstream side along the conveyance path by arranging the guiding portion, a contact period of the sheet with the claw member having a high temperature due to the contact with the outer circumferential surface of the fixing roller can be shortened. The guiding portion is arranged in the vicinity of the tip of the claw member in order to guide the sheet to the rotary member, whereby the rotary member guides the sheet at the downstream side of the conveyance path while being rotated even if the separated sheet is conveyed while being pressed against the guiding portion due to the elasticity thereof. Therefore, a degree of contact of the sheet with the guiding portion can be sufficiently moderated.

Accordingly, in the fixing device having the above construction, the sheet can be smoothly brought into contact with the outer circumferential surface of the rotary member while it is suppressed to largely change the sheet conveyance direction. Thus, loads exerted to the sheet can be reduced. Since this enables an occurrence of scratching the sheet due to the contact of a part of the pulled-back sheet with the claw member, a reduction in image quality can be suppressed. Further, the melting (remelting) of toner on the sheet separated from the fixing roller can be suppressed since the contact period of the sheet with the claw member having a high temperature due to the contact with the outer circumferential surface of the fixing roller can be shortened. This can also hinder an occurrence of scratching an image formed on the sheet by the claw member, therefore a reduction in image quality can be further suppressed. Particularly if the guiding portion is arranged at a position relatively close to the tip of the claw member, the sheet separated from the fixing roller can be transferred from the claw member to the guiding portion at the position relatively close to the tip of the claw member as a separating position of the sheet. Thus, the contact period of the sheet with the claw member having a high temperature can be further shortened. Further, since a degree of contact of the sheet with the guiding portion can be sufficiently moderated, an occurrence of image abrasion on the outer surface of the image on the sheet can be sufficiently suppressed.

In the above fixing device, the guiding portion preferably guides at least the leading end of the sheet separated from the fixing roller by the claw member toward the outer circumferential surface of the rotary member.

With such a construction, the leading end of the sheet conveyed while being held in contact with the claw member and the guiding portion after the separation can be smoothly brought into contact with the outer circumferential surface of the rotary member to reduce loads exerted to the leading end of the sheet since the leading end of the sheet separated from the fixing roller can be actively guided toward the outer circumferential surface of the rotary member by the guiding portion. Accordingly, an occurrence of scratching the sheet by the claw member due to the contact of a part of the pulled-back sheet with the claw member can be better suppressed. Therefore, a reduction in image quality can be sufficiently suppressed.

In the above fixing device, it is preferable to arrange the holder member in such a manner as not to touch the fixing roller and to set a temperature of the contact part of the guiding portion with the sheet to be lower than a temperature of a contact part of the claw member with the sheet. With such a construction, the sheet separated to the fixing roller by the claw member can be transferred from the guiding portion of the holder member having a lower temperature than the claw member and guided to the downstream side along the conveyance path by the guiding portion, therefore the contact period of the sheet with the claw member having a high temperature can be securely shortened. Therefore, the melting (remelting) of the toner on the sheet separated from the fixing roller can be better suppressed.

In the above fixing device, the holder member preferably includes a first holding portion extending in a specified direction and adapted to fixedly hold the claw member and a second holding portion extending in the specified direction and adapted to rotatably hold the rotary member in the vicinity of the claw member, and the rotary member is preferably held on the second holding portion with a specified play defined to the claw member in the extending direction of the second holding portion so as to be movable away from the claw member. With such a construction, the rotary member and the claw member are intermittently brought out of contact while, for example, the claw member suitably comes into contact with the rotary member in the extending direction of the second holding portion because of the presence of the "play". Thus, an excessive temperature increase of the rotary member can be suppressed while the rotary member is prevented from coming off the second holding portion. Therefore, influence given to the image on the sheet by the rotary member can be reduced while hindering an increase in the number of parts.

In the case of employing such a construction, the second holding portion may be comprised of columns extending in a rotational axis direction of the fixing roller and arranged on opposite side portions of the claw member, and the rotary member may be comprised of a pair of roller members each formed with a shaft hole into which the corresponding column is insertable, wherein the two roller members are so arranged as to sandwich the claw member by inserting the columns on the opposite side portions into the shaft holes of the respective roller members. With such a construction, the rotary member can be simply constructed and the sheet can be stably conveyed by the two roller members.

In the above fixing device, the tip portion of the claw member may have a specified width in the rotational axis direction of the fixing roller and the rotary member may be arranged within an area extending downstream from the tip portion along the conveyance path while having this specified width. More specifically, the tip portion of the claw member may have the specified width in the rotational axis direction of the fixing roller and the holder member may include a first holding portion for fixedly holding the claw member and a second holding portion for rotatably holding the rotary member within an area extending downstream from the tip portion along the conveyance path while having this specified width.

With such a construction, the rotary member can be arranged between the sheet separated from the fixing roller by the tip portion and the claw member, therefore the sheet is more unlikely to come into contact with the claw member if a force acts to displace the sheet in a direction toward the claw member, for example, when the sheet separated from the fixing roller experiences a corrugation phenomenon, a pull-back phenomenon or the like. In this way, an occurrence of such a problem as to scratch the sheet by the contact of the sheet separated from the fixing roller again with the claw member. Therefore, a reduction in image quality can be sufficiently suppressed.

In this case, it is preferable that the rotary member includes a roller member formed with a shaft hole into which a column is insertable; the claw member includes a trunk portion having a width substantially equal to that of the tip portion, extending downstream along the conveyance path and formed with a hollow portion having such a size capable of accommodating the roller member; the second holding portion includes the column extending in the rotational axis direction of the fixing roller and arranged to cross the hollow portion; and the roller member is assembled by inserting the column into the shaft hole while being accommodated in the hollow portion. With such a construction, since the hollow portion is located within an extension area extending downstream from the tip portion along the conveyance path while having the width of the tip portion, the rotary member can be easily located within the extension area.

In the above fixing device, the rotary member preferably has at least outer surface thereof made of a fluoroplastic. Such a rotary member has a good heat resistance and a low friction coefficient with the sheet. For example, a tetrafluoroethylene-perfluoroalkoxyethylene copolymer (PFA) and a tetrafluoroethylene resin (PTFE) can be named as the fluoroplastic as the material of the rotary member. Since the rotary member has a good heat resistance and a low friction coefficient with the sheet, physical loads given to the image on the sheet can be reduced to quite a small level when the rotary member guides the sheet to the downstream side along the conveyance path while being rotated.

In the above fixing device, the holder member may hold the claw member such that the claw member is freely movable in directions about two axes and include a biasing member for biasing the claw member toward the circumferential surface of the fixing roller so that the tip portion of the claw member presses the fixing roller.

By constructing the claw member to be freely movable at least in the directions about two axes, the claw member can quickly pivot in such a direction as to correct the posture thereof while yielding to a biasing force of the biasing member even if only one side of the claw member is in contact with the outer circumferential surface of the fixing roller, for example, due to the dimensional tolerance or the like of components. Thus, the claw member can be constantly held in contact (close contact) with the outer circumferential surface of the fixing roller at a uniform pressure. Since this can increase a contact area of the claw member and the outer circumferential surface of the fixing roller, a contact pressure per unit area given by the claw member to the fixing roller can be reduced.

In this case, the claw member preferably pivots in first directions about an axis substantially parallel to the central axis of the fixing roller and in second directions about an axis substantially normal to the central axis of the fixing roller. With such a construction, if only one side of the claw member is in contact with the fixing roller, the claw member can quickly pivot in the second direction about the axis substantially normal to the central axis of the fixing roller to correct the posture thereof, therefore the claw member can be securely held in close contact with the outer circumferential surface of the fixing roller.

In the above fixing device, the holder member may support the claw member such that the claw member is freely movable in directions about many axes and include a biasing member for biasing the claw member toward the outer circumferential surface of the fixing roller so that the tip portion of the claw member presses the fixing roller.

Such a posture of the claw member as to hold only one side thereof with the fixing roller can also be corrected as in the above case by constructing the claw member to be freely movable in the directions about many axes.

In this case, the claw member preferably includes a pivotal supporting portion provided at a specified distance from the tip portion in contact with the outer circumferential surface of the fixing roller and functioning as a supporting point in a pivoting state. With such a construction, the tip portion in contact with the outer circumferential surface of the fixing roller can be easily caused to pivot with the pivotal supporting portion as the supporting point.

An image forming apparatus according to another aspect of the present invention comprises an image forming unit for transferring a toner image to a sheet, and a fixing device for fixing the toner image transferred in the image forming unit to the sheet by heating, the fixing device including a fixing roller for fixing a toner image transferred onto a sheet and conveying the sheet along a specified conveyance path, and a separating mechanism for separating the sheet from the fixing roller, the separating mechanism including a claw member having a tip portion held in contact with the outer circumferential surface of the fixing roller for separating the sheet from the fixing roller, a holder member for holding the claw member and a rotary member rotatably held in the holder member at a position downstream of the tip portion of the claw member with respect to the conveyance path and adapted to guide the sheet separated from the fixing roller to a downstream side along the conveyance path while being rotated, the holder member having a guiding portion for guiding the sheet to the rotary member on the conveyance path between the tip portion and the claw member and the rotary member.

According to such an image forming apparatus, the toner image transferred to the sheet in the image forming unit to the sheet can be fixed using the fixing device capable of sufficiently suppressing a reduction in image quality, therefore a high-quality image can be easily formed while suppressing a reduction in image quality.

This application is based on patent application Nos. 2005-251770, 2005-337403, 2005-343243, 2006-141416 and 2006-207360 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A fixing device, comprising:

a fixing roller for fixing a toner image transferred onto a sheet and conveying the sheet along a specified conveyance path, and a separating mechanism for separating the sheet from the fixing roller, the separating mechanism including a claw member having a tip portion in contact with the outer circumferential surface of the fixing roller to separate the sheet from the fixing roller, a holder member for holding the claw member, and a rotary member rotatably held in the holder member at a position downstream of the tip portion of the claw member with respect to the conveyance path and adapted to guide the sheet separated from the fixing roller to a downstream side along the conveyance path while being rotated, the holder member having a guiding portion for guiding the sheet to the rotary member on the conveyance path between the tip portion of the claw member and the rotary member, wherein the holder member includes a first holder member and a second holder member so arranged as to rotatably sandwich the rotary member therebetween, the guiding portion being formed on each of the first holder member and the second holder member.

2. A fixing device according to claim 1, wherein the guiding portion guides at least the leading end of the sheet separated from the fixing roller by the claw member toward the circumferential surface of the rotary member.

3. A fixing device according to claim 1, wherein the holder member is so arranged as not to touch the fixing roller, and the temperature of a contact part of the guide portion with the sheet is set to be lower than that of a contact part of the claw member with the sheet in an operative state of the device.

4. A fixing device according to claim 3, wherein:

the holder member includes a first holding portion extending in a specified direction for fixedly holding the claw member, and a second holding portion extending in the specified direction for rotatably holding the rotary member in the vicinity of the claw member, and the rotary member is held on the second holding portion with a specified play defined to the claw member in the extending direction of the second holding portion so as to be movable away from the claw member.

5. A fixing device according to claim 4, wherein:

the first and second holding portions include first and second columns extending in a rotational axis direction of the fixing roller and arranged at opposite side portions of the claw member, and the rotary member includes first and second roller members each formed with a shaft hole into which the corresponding column is insertable, the roller members being arranged to sandwich the claw member by inserting the columns of the opposite side portions into the shaft holes of the respective roller members.

6. A fixing device according to claim 3, wherein:

the tip portion of the claw member has a specified width in the rotational axis direction of the fixing roller, and the holder member includes a first holding portion for fixedly holding the claw member and a second holding portion for rotatably holding the rotary member in an area extending downstream from the tip portion along the conveyance path while having the width of the tip portion.

7. A fixing device according to claim 6, wherein:

the rotary member includes a roller member formed with a shaft hole into which a column is insertable, the claw member includes a trunk portion having a width substantially equal to that of the tip portion, extending downstream along the conveyance path, and formed with a hollow portion having such a size capable of accommodating the roller member, the second holding portion includes the column extending in the rotational axis direction of the fixing roller and is so arranged as to cross the hollow portion, and the roller member is assembled by inserting the column into the shaft hole while being accommodated in the hollow portion.

8. A fixing device according to claim 1, wherein:

the tip portion of the claw member has a specified width in the rotational axis direction of the fixing roller, and the rotary member is arranged in an area extending downstream from the tip portion along the conveyance path while having the width of the tip portion.

9. A fixing device according to claim 1, wherein the rotary member has at least the outer surface thereof made of a fluoroplastic.

10. A fixing device according to claim 1, wherein the holder member supports the claw member such that the claw member is freely movable in directions about two axes and includes a biasing member for biasing the claw member toward the outer circumferential surface of the fixing roller so that the tip portion of the claw member presses the fixing roller.

11. A fixing device according to claim 10, wherein the claw member pivots in first directions about an axis substantially parallel to the central axis of the fixing roller and pivots in second directions about an axis substantially normal to the central axis of the fixing roller.

12. A fixing device according to claim 1, wherein the holder member supports the claw member such that the claw member are freely movable in directions about many axes and includes a biasing member for biasing the claw member toward the outer circumferential surface of the fixing roller so that the tip portion of the claw member presses the fixing roller.

13. A fixing device according to claim 12, wherein the claw member includes a pivotal supporting portion provided at a specified distance from the tip portion in contact with the outer circumferential surface of the fixing roller and functioning as a supporting point in a pivoting state.

14. An image forming apparatus, comprising:

an image forming unit for transferring a toner image to a sheet, and a fixing device for fixing the toner image transferred in the image forming unit to the sheet by heating, wherein the fixing device comprises:

a fixing roller for fixing a toner image transferred onto a sheet and conveying the sheet along a specified conveyance path, a separating mechanism for separating the sheet from the fixing roller, the separating mechanism including a claw member having a tip portion in contact with the outer circumferential surface of the fixing roller to separate the sheet from the fixing roller, a holder member for holding the claw member, and a rotary member rotatably held in the holder member at a position downstream of the tip portion of the claw member with respect to the conveyance path and adapted to guide the sheet separated from the fixing roller to a downstream side along the conveyance path while being rotated, the holder member having a guiding portion for guiding the sheet to the rotary member on the conveyance path between the tip portion of the claw member and the rotary member, and wherein the holder member includes a first holder member and a second holder member so arranged as to rotatably sandwich the rotary member therebetween, the guiding portion being formed on each of the first holder member and the second holder member.

15. An image forming apparatus according to claim 14, wherein the holder member is so arranged as not to touch the fixing roller, and the temperature of a contact part of the guide portion with the sheet is set to be lower than that of a contact part of the claw member with the sheet in an operative state of the device.

16. A fixing device comprising:

a fixing roller for fixing a toner image transferred onto a sheet and conveying the sheet along a specified conveyance path; and a separating mechanism for separating the sheet from the fixing roller, the separating mechanism including:

a claw having a tip in contact with an outer circumferential surface of the fixing roller to separate the sheet from the fixing roller, a first holding portion extending in a specified direction for fixedly holding the claw, a second holding portion extending in the specified direction for rotatably holding a rotary member in the vicinity of the claw, and at a position downstream of the tip of the claw with respect to the conveyance path and adapted to guide the sheet separated from the fixing roller to a downstream side along the conveyance path while being rotated, the rotary member being held on the second holding portion with a specified play defined to the claw in the extending direction of the second holding portion so as to be movable away from the claw, and a guiding portion for guiding the sheet to the rotary member on the conveyance path between the tip of the claw and the rotary member, wherein the first and second holding portions are arranged so as not to touch the fixing roller, and the temperature of a contact part of the guide portion with the sheet is set to be lower than that of a contact part of the claw with the sheet in an operative state of the device.

17. A fixing device according to claim 16, wherein:

the first and second holding portions are provided respectively with first and second columns extending in a rotational axis direction of the fixing roller and arranged at opposite sides of the claw, and the rotary member includes first and second rollers each formed with a shaft hole into which the corresponding column is insertable, the first and second rollers being arranged to sandwich the claw by inserting the columns of the opposite sides into the shaft holes of the respective rollers.

* * * * *